US006579574B2

(12) United States Patent
Seaver et al.

(10) Patent No.: US 6,579,574 B2
(45) Date of Patent: Jun. 17, 2003

(54) VARIABLE ELECTROSTATIC SPRAY COATING APPARATUS AND METHOD

(75) Inventors: Albert E. Seaver, Woodbury, MN (US); William K. Leonard, River Falls, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 58 days.

(21) Appl. No.: 09/841,381

(22) Filed: Apr. 24, 2001

(65) Prior Publication Data

US 2002/0182333 A1 Dec. 5, 2002

(51) Int. Cl.[7] ..... B05D 1/04; B05D 3/12; B05B 5/025

(52) U.S. Cl. ..... 427/466; 427/467; 427/472; 427/479; 427/482; 427/483; 118/629; 118/638

(58) Field of Search ..... 427/466, 467, 427/469, 475, 479, 480, 482, 483, 355, 358, 364, 365, 371, 472; 118/626, 629, 638; 239/3, 690, 695

(56) References Cited

U.S. PATENT DOCUMENTS

| | | | |
|---|---|---|---|
| 1,043,021 | A | 10/1912 | Mayer |
| 2,105,488 | A | 1/1938 | Massey et al. |
| 2,105,981 | A | 1/1938 | Massey et al. |
| 2,229,620 | A | 1/1941 | Bradner |
| 2,229,621 | A | 1/1941 | Bradner |
| 2,237,068 | A | 4/1941 | Bradner |

(List continued on next page.)

FOREIGN PATENT DOCUMENTS

EP 0 949 380 A2 10/1999

GB 1 278 099 * 6/1972

OTHER PUBLICATIONS

"The Coating Machine", Booth, G.L., *Pulp and Paper Manufacture*, vol. 8, *Coating, Converting and Processes*, pp. 76–87, Third Edition, 1990.

*Coating and Drying Defects*, Gutooff and Cohen, John Wiley & Sons, New York, 1995.

"Multiple Roll Systems: Steady–State Operation", D.F. Benjiman, T.J. Anderson, and L.E. Scriven, AIChEJ., V41, p. 1045, 1995.

"Multiple Roll Systems: Residence Times and Dynamic Response", D.F. Benjamin, T.J. Anderson, and L.E. Scriven, AIChEJ., V41, p. 2198, 1995.

Seaver, A.E., Analysis of Electrostatic Measurements on Non–Conducting Webs; *J. Electrostatics*, vol. 35, No. 2 (1995), pp. 231–243.

Polymer Handbook, 3rd Edition, Editors J. Brandrup and E.H. Immergut, Wiley, New York (1989), p. V/101.

Cross, J.A., Electrostatics: Principles, Problems and Applications, Adam Hilger, Bristol (1987), p. 81.

Dangelmayer, G.T., ESD Program Management, Van Nostrand Reinhold, New York (1990) p. 40.

Ser. No. 09/757,955, Filed Jan. 10, 2001.

Ser. No. 09/841,380, Filed Apr. 24, 2001.

"Evolution of Coating", by George L. Booth, Published by Gorham International Inc.,Gorham, Maine, vol. 1, Dec., 1995.

*Primary Examiner*—Fred J. Parker
(74) *Attorney, Agent, or Firm*—Brian E. Szymanski

(57) ABSTRACT

A liquid coating is formed by spraying drops of liquid onto a substrate or a transfer surface from an electrostatic spray head that produces a mist of drops and a wet coating in response to an electrostatic field. During spraying, the electrostatic field is repeatedly altered to change the pattern deposited by the drops. The wet coating can be contacted with two or more pick-and-place devices that improve the uniformity of the coating.

50 Claims, 17 Drawing Sheets

U.S. PATENT DOCUMENTS

| | | | | |
|---|---|---|---|---|
| 2,245,045 | A | | 6/1941 | Montgomery et al. |
| 2,447,664 | A | | 8/1948 | Pegg |
| 2,685,536 | A | | 8/1954 | Starkey et al. |
| 2,695,002 | A | | 11/1954 | Miller |
| 2,710,589 | A | | 6/1955 | Brunner |
| 2,733,171 | A | | 1/1956 | Ransburg |
| 2,762,331 | A | | 9/1956 | Henderson |
| 2,809,128 | A | | 10/1957 | Miller |
| 2,833,666 | A | | 6/1958 | Neidich |
| 2,893,894 | A | | 7/1959 | Ransburg |
| 2,994,618 | A | | 8/1961 | Landgraf |
| 3,018,757 | A | | 1/1962 | Loppnow |
| 3,486,483 | A | | 12/1969 | Tilney et al. |
| 3,726,701 | A | | 4/1973 | Nishikawa et al. |
| 3,730,433 | A | * | 5/1973 | Scharfenberger |
| 3,920,862 | A | | 11/1975 | Damschroder et al. |
| 4,073,966 | A | | 2/1978 | Scholes et al. |
| 4,170,193 | A | | 10/1979 | Scholes et al. |
| 4,267,215 | A | | 5/1981 | Riggs |
| 4,378,390 | A | | 3/1983 | Yoshida et al. |
| 4,503,802 | A | | 3/1985 | Keller et al. |
| 4,569,864 | A | | 2/1986 | McIntyre |
| 4,748,043 | A | * | 5/1988 | Seaver et al. |
| 4,749,125 | A | | 6/1988 | Escallon et al. |
| 4,788,016 | A | | 11/1988 | Colclough et al. |
| 4,830,872 | A | | 5/1989 | Grenfell |
| 4,830,873 | A | | 5/1989 | Benz et al. |
| 4,846,407 | A | | 7/1989 | Coffee et al. |
| 4,847,110 | A | | 7/1989 | Nakajima et al. |
| 4,854,506 | A | | 8/1989 | Noakes et al. |
| 4,990,359 | A | | 2/1991 | Knobbe |
| 5,049,404 | A | | 9/1991 | Kisler et al. |
| 5,222,663 | A | * | 6/1993 | Noakes et al. |
| 5,326,598 | A | * | 7/1994 | Seaver et al. |
| 5,332,797 | A | | 7/1994 | Kessel et al. |
| 5,447,474 | A | | 9/1995 | Chang |
| 5,460,120 | A | | 10/1995 | Paul et al. |
| 5,536,314 | A | | 7/1996 | Rannestad |
| 5,585,545 | A | | 12/1996 | Bennett et al. |
| 5,599,602 | A | | 2/1997 | Leonard et al. |
| 5,620,514 | A | | 4/1997 | Munter et al. |
| 5,702,527 | A | | 12/1997 | Seaver et al. |
| 5,733,608 | A | | 3/1998 | Kessel et al. |
| 5,858,545 | A | | 1/1999 | Everaerts et al. |
| 5,871,585 | A | | 2/1999 | Most et al. |
| 5,954,907 | A | | 9/1999 | LaRose et al. |

* cited by examiner

VARIABLE ELECTROSTATIC SPRAY COATING APPARATUS AND METHOD

TECHNICAL FIELD

This invention relates to devices and methods for coating substrates.

BACKGROUND

Electrostatic spray coating typically involves atomizing a liquid and depositing the atomized drops in an electrostatic field. The average drop diameter and drop size distribution can vary widely depending on the specific spray coating head. Other factors such as the electrical conductivity, surface tension and viscosity of the liquid also play an important part in determining the drop diameter and drop size distribution. Representative electrostatic spray coating heads and devices are shown in, e.g., U.S. Pat. Nos. 2,685,536; 2,695,002; 2,733,171; 2,809,128; 2,893,894; 3,486,483; 4,748,043; 4,749,125; 4,788,016; 4,830,872; 4,846,407; 4,854,506; 4,990,359; 5,049,404; 5,326,598; 5,702,527 and 5,954,907. Devices for electrostatically spraying can-forming lubricants onto a metal strip are shown in, e.g., U.S. Pat. Nos. 2,447,664; 2,710,589; 2,762,331; 2,994,618; 3,726,701; 4,073,966 and 4,170,193. Roll coating applicators are shown in, e.g., U.S. Pat. No. 4,569,864, European Published Patent Application No. 949380 A and German OLS DE 198 14689 A1.

In general, the liquid sent to the spray coating head breaks up into drops due to instability in the liquid flow, often at least partially influenced by the applied electrostatic field. Typically, the charged drops from electrostatic spray heads are directed by electric fields towards an article, endless web or other substrate that moves past the spray head. In some applications, the desired coating thickness is larger than the average drop diameter, the drops land on top of one other, and they coalesce to form the coating. In other applications, the desired coating thickness is smaller than the average drop diameter, the drops are spaced apart at impact, and the drops must spread to form a continuous voidless coating.

Devices for electrostatically spraying can-forming lubricants onto a metal strip are shown in, e.g., U.S. Pat. Nos. 3,726,701; 4,073,966 and 4,170,193. In U.S. Pat. No. 3,726,701, the electrostatic potential is adjusted based on the speed and deposition rate of the article to be coated.

U.S. Pat. No. 2,733,171 employs mechanical oscillation of an electrostatic spray head and intermittent movement of the spray head electrostatic discharge wire in order to reduce striping or ribbing of the deposited coating material.

U.S. Pat. No. 5,049,404 employs piezoelectric vibration of a dielectric electrostatic spray nozzle in order to stabilize the surface shape of the liquid leaving the nozzle, reduce nozzle clogging at low flow rates and obtain extremely thin coatings.

SUMMARY OF THE INVENTION

Our copending U.S. patent application Ser. No. 09/841,380, filed Apr. 24, 2001 entitled ELECTROSTATIC SPRAY COATING APPARATUS AND METHOD and incorporated herein by reference discloses an apparatus and methods for applying a liquid coating to a substrate by electrostatically spraying drops of the liquid onto a liquid-wetted conductive transfer surface, and transferring a portion of the thus-applied liquid from the transfer surface to the substrate to form the coating.

Our copending U.S. patent application Ser. No. 09/757,955 filed Jan. 10, 2001 entitled COATING DEVICE AND METHOD and incorporated herein by reference discloses devices and methods for improving the uniformity of a wet coating on a substrate. The coating is contacted at a first position with the wetted surfaces of two or more periodic pick-and-place devices, and re-contacted at positions on the substrate that are different from the first position and not periodically related to one another with respect to their distance from the first position. The coating can be applied using point source nozzles such as airless, electrostatic, spinning disk and pneumatic spray nozzles and line source atomization devices. The nozzle or nozzles can be oscillated back and forth across the substrate.

The apparatus, devices and methods of the above-mentioned applications can provide very uniform coatings, especially when used in combination.

The present invention also provides an improvement in coating uniformity. In one aspect, the invention provides a method for forming a liquid coating on a substrate, comprising:

a) spraying a pattern of drops of the liquid onto a substrate from an electrostatic spray head that produces the pattern in response to an electrostatic field; and b) repeatedly electrically altering the electrostatic field during spraying, thereby repeatedly changing the pattern.

A preferred method comprises spraying the pattern of drops onto a conductive transfer surface, and transferring a portion of the thus-applied liquid from the transfer surface to the substrate to form the liquid coating.

In another aspect, the invention provides a method for forming a liquid coating on a substrate, comprising:

a) spraying a pattern of drops of the liquid onto the substrate or onto a transfer surface from an electrostatic spray head that produces the pattern in response to an electrostatic field;

b) repeatedly changing the pattern in a first direction; and c) in either order:

i) when a transfer surface is employed, transferring a portion of the thus-applied coating from the transfer surface to the substrate; and ii) contacting the coating with two or more pick-and-place devices that improve the uniformity of the coating in a second direction.

The invention also provides an apparatus comprising an electrostatic spray head that produces a pattern of drops and a wet coating on a substrate in response to an electrostatic field, and a device or circuit for repeatedly electrically altering the electrostatic field during spraying, thereby repeatedly changing the pattern. In a preferred embodiment, the device or circuit changes the pattern in a first direction and the apparatus further comprises two or more pick-and-place devices that can periodically contact and re-contact the wet coating to improve the uniformity of the coating in a second direction.

The methods and apparatus of the invention can provide substantially uniform thin film or thick film coatings, on conductive, semi-conductive, insulative, porous or non-porous substrates. The apparatus of the invention is simple to construct, set up and operate, and can easily be adjusted to alter coating thickness and coating uniformity.

DETAILED DESCRIPTION OF THE INVENTION

Figure 1A:
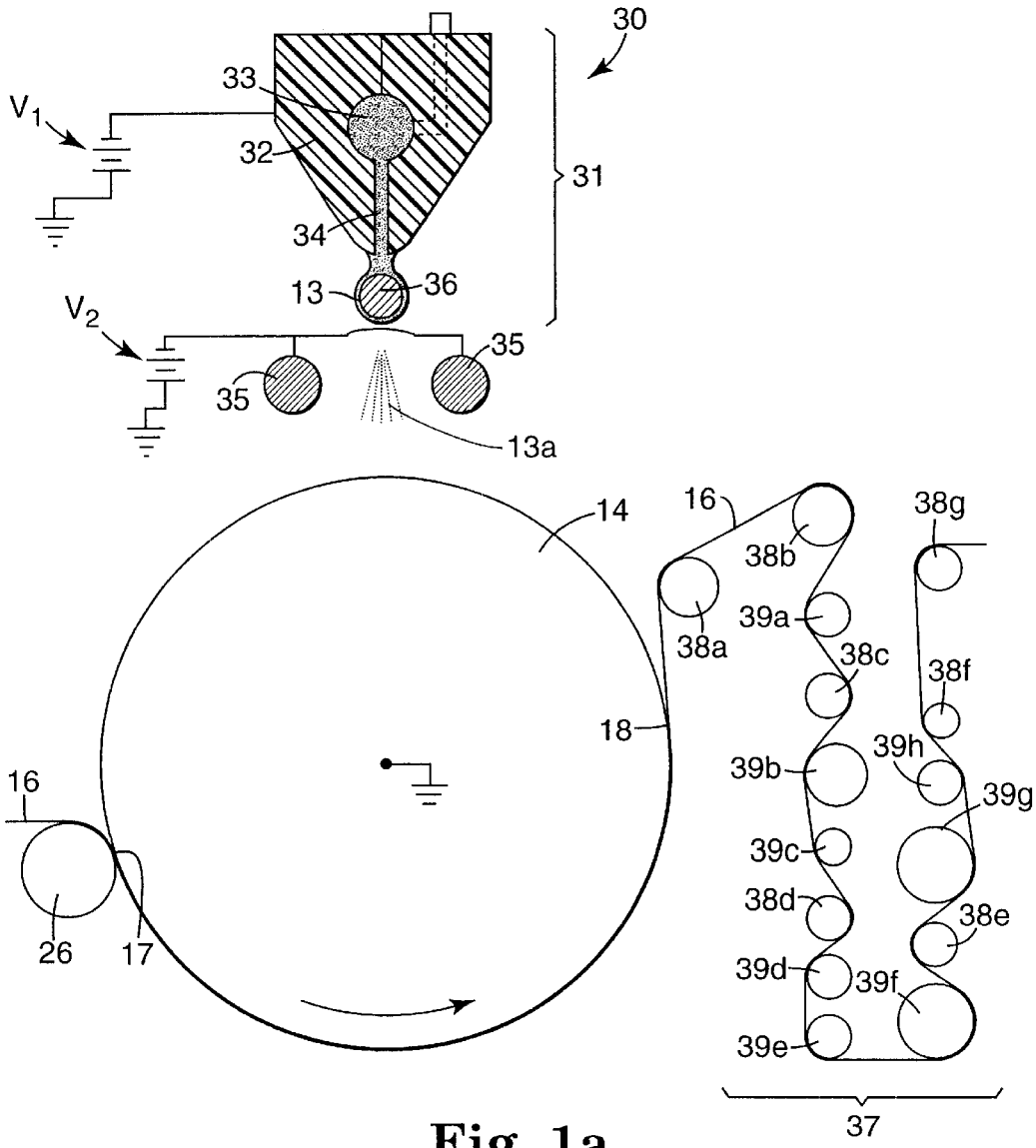
FIG. 1*a* is a schematic side view of an apparatus of the invention.

In some electrostatic spray-coating processes, the desired coating thickness is less than the average diameter of the drops that will be deposited by the electrostatic spray coating head. We will refer to such processes as "thin film processes", and to the resulting coatings as "thin film coatings". In other electrostatic spray-coating processes, the desired coating thickness is greater than the average drop diameter. We will refer to such processes as "thick film processes", and to the resulting coatings as "thick film coatings".

The invention provides a simple coating process that can be used to apply substantially uniform, void-free thin film and thick film coatings on conductive, semi-conductive, insulated, porous or non-porous substrates, using solvent-based, water-based or solventless coating compositions. The electrostatic spray apparatus of the invention is especially useful for, but not limited to, coating moving webs. If desired, the substrate can be a discrete object or a train or array of discrete objects having finite dimensions. In some embodiments, the coatings can be formed without depositing on the substrate the electrical charges generated by the electrostatic spray coating head used to apply the coating.

In one embodiment of the invention, an electrostatic field is repeatedly electrically altered during spraying, thereby repeatedly changing a pattern of drops deposited on a target substrate. In another embodiment, the pattern of drops deposited on a target substrate is repeatedly changed in a first direction (e.g., by employing a repeatedly electrically altered or repeatedly mechanically altered electrostatic field), and a wet coating formed from the drops is contacted with two or more pick-and-place devices to improve the uniformity of the coating in a second direction.

By a "repeatedly changing pattern of drops" or a "repeatedly changed pattern of drops", we mean that when a wet liquid coating is electrostatically applied to a moving target substrate having a direction of motion, the outline of the coated portion is physically moved in a direction other than the substrate direction of motion, or that the distribution or coating weight of wet coating on the substrate is altered in a direction other than the substrate direction of motion, and that such movement or alteration is recurrent. Such a pattern change can arise, for example through changes in the locations in space (relative to a point on the spray head) at which drops are created, or through changes in the size, number or trajectory of the drops. For example, where the substrate moves in a first direction, the outline of the coated area formed by the pattern of drops could be moved in a second direction, moved in one or more third directions, and then moved in the second direction again and again; the outline could enlarge, shrink, and then enlarge again and again; or the drops within the coated area could be arranged in a first distribution or coating weight, arranged in one or more other distributions or coating weights, and then arranged in the first distribution or coating weight again and again. These recurrent changes do not need to be continuous, periodic, cyclical, or equal in magnitude. The changes preferably should be made sufficiently frequently during spraying so that the pattern of drops is not held constant for an extended length of time.

By a "repeatedly mechanically altered" electrostatic field, we mean that when a wet liquid coating is electrostatically applied to a moving target substrate having a direction of motion, the position of the spray head with respect to a fixed point in space above the target is moved sufficiently so that the pattern of drops changes, and that the movement is recurrent. These recurrent movements do not need to be continuous, periodic, cyclical, or equal in magnitude. The movements preferably should be made sufficiently frequently during spraying so that the pattern of drops is not held constant for an extended length of time. The movements can be carried out, for example, by increasing or decreasing the spray head to target distance, or by moving the spray head in a direction of motion parallel to the target.

By a "repeatedly electrically altered" electrostatic field, we mean that the applied voltage or the voltage with respect to ground on the spray head (or on one or more other objects near the spray head and target, such as a field adjusting electrode or a second spray head) is varied sufficiently so that the electrostatic field and pattern of drops changes and that the variation is recurrent; or that an object other than the spray head or target is moved sufficiently with respect to the spray head so that the electrostatic field and pattern of drops changes and that the movement is recurrent. These recurrent variations or movements do not need to be continuous, periodic, cyclical, or equal in magnitude. They preferably should be made sufficiently frequently during spraying so that the pattern of drops is not held constant for an extended length of time. The variations or movements can be carried out, for example, by changing the voltage between the spray head and the target from a first value to a higher or lower value and then back in the direction of the first value; by changing the voltage applied to a nearby field adjusting electrode; by changing the voltage applied to a nearby electrostatic spray head; or by moving a nearby field adjusting electrode or second electrostatic spray head.

By "during spraying", we mean while drops are being emitted by the electrostatic spray head.

By "improve the uniformity of the coating", we mean that the coating exhibits greater uniformity than a similar coating prepared without the above-mentioned alteration in the electrostatic field, when evaluated according to one or more uniformity metrics. Many criteria can be applied to measure coating uniformity improvement. Examples include caliper standard deviation, ratio of minimum (or maximum) caliper divided by average caliper, range (which we define as the maximum caliper minus the minimum caliper over time at a fixed observation point), and reduction in void area. For example, preferred embodiments of our invention provide range reductions of greater than 75% or even greater than 90%. For discontinuous coatings (or in other words, coatings that initially have voids), our invention enables reductions in the total void area of greater than 50%, greater than 75%, greater than 90%, greater than 99% or even complete elimination of detectable voids. Those skilled in the art will recognize that the desired degree of coating uniformity improvement will depend on many factors including the type of coating, coating equipment and coating conditions, and the intended use for the coated substrate.

In a preferred embodiment of the invention, the drop pattern is changed in a first direction and two or more pick-and-place devices are employed to improve the uniformity of the coating in a second direction, with both directions being in the plane of the substrate and being different from one another. For coatings applied to a moving web, the first direction will typically be the cross-web or transverse direction and the second direction will typically be the longitudinal or machine direction.

Referring to FIG. 1*a*, electrostatic spray coating apparatus 30 includes electrostatic spray head 31 for dispensing a pattern of drops or mists 13*a* of coating liquid 13 onto rotating grounded drum 14. Drum 14 continuously circulates past spray head 11, periodically presenting and representing the same points on the drum under spray head 11 at intervals defined by the rotational period of drum 14. Those skilled in the art will realize that the drum or other conductive transfer surface in such an apparatus need not be grounded. Instead, if desired, the conductive transfer surface need only be at a lower voltage than the charged atomized drops. However, it generally will be most convenient to ground the conductive transfer surface.

Spray head 31 is shown in U.S. Pat. No. 5,326,598, and is sometimes referred to as an "electrospray head." A variety of types of electrostatic spray heads can be employed, including those shown in the patents referred to above. Preferably the electrostatic spray head produces a substantially uniform mist of charged drops. The spray head can have a series of discharge protrusions, with one or more arrays of mists of liquid being discharged from the protrusions, and with the mist patterns varying during spraying. More preferably the electrostatic spray head (or a series of electrostatic spray heads that have been suitably ganged together) produces a line or other array of charged drops, which drops form one or more mists. Spray head 31 includes die body 32 having liquid supply gallery 33 and slot 34. Liquid 13 flows through gallery 33 and slot 34, then over wire 36, forming a thin film of liquid 13 with a substantially constant radius of curvature around wire 36. A first voltage $V_1$ between spray head 31 and drum 14 creates an electric field that helps atomize the drops and urge them toward drum 14. The electrostatic field affecting these drops is repeatedly varied during spraying in order to change the pattern of drops deposited by spray head 31. An optional second voltage $V_2$ between electrodes 35 and drum 14 creates an additional electric field that helps urge the drops toward drum 14. If desired, second voltage $V_2$ can be omitted and electrodes 35 can be grounded. When voltage $V_1$ is applied, liquid 13 forms a series of spaced liquid filaments (not shown in FIG. 3*a*) that break apart into mists 13*a* extending downward from wire 36. The mists 13*a* break apart at their tips to generate uniform mists of highly charged drops that land on rotating drum 14. For a given applied voltage, the mists 13*a* are spatially and temporally fixed along wire 36. Variation in the applied voltage $V_1$ will cause the number and spacing of filaments and mists along wire 36 to change, thereby shifting in the cross web direction the pattern of drops deposited on drum 14.

As drum 14 rotates, it brings the applied drops into contact with moving web 16 at entry point 17. Nip roll 26 forces moving web 16 against drum 14 at entry point 17. The nip pressure helps to spread and coalesce the drops that have already landed on drum 14 into a void-free coating prior to separation point 18. At the separation point 18, part of the coating remains on web 16 while the remainder of the coating remains on drum 14. After several revolutions of drum 14, a steady state is reached, the entire surface of drum 14 becomes wet with the coating, and the amount of coating being removed by web 16 equals the amount being deposited on drum 14. The wet surface on drum 14 assists newly applied drops of liquid 13 in spreading and coalescing prior to contact with web 16. Drop spreading issues are further reduced due to the pressure exerted by nip roll 26 on drum 14. The drops coalesce and the coating becomes continuous in a much shorter time than is the case when atomized drops are sprayed directly onto a substrate and spread at a rate based on the drop's own physical properties. This is especially helpful for thin coatings, where the drops tend to be widely separated.

Apparatus 30 incorporates an 8-roll improvement station 37 whose operation is described in the above-mentioned copending U.S. patent application Ser. No. 09/757,955, filed Jan. 10, 2001. Improvement station 37 has idler rolls 38*a* through 38*g* and unequal diameter pick-and-place rolls 39*a* through 39*h*. While in the improvement station, the wet side of web 16 contacts the wet surfaces of pick-and-place rolls 39*a* through 39*h*, whereupon the coating becomes more uniform in the down-web direction as will be explained in more detail below. The apparatus and method shown in FIG. 1*a* is especially useful for forming very thin coatings with high down web uniformity.

Figure 1B:
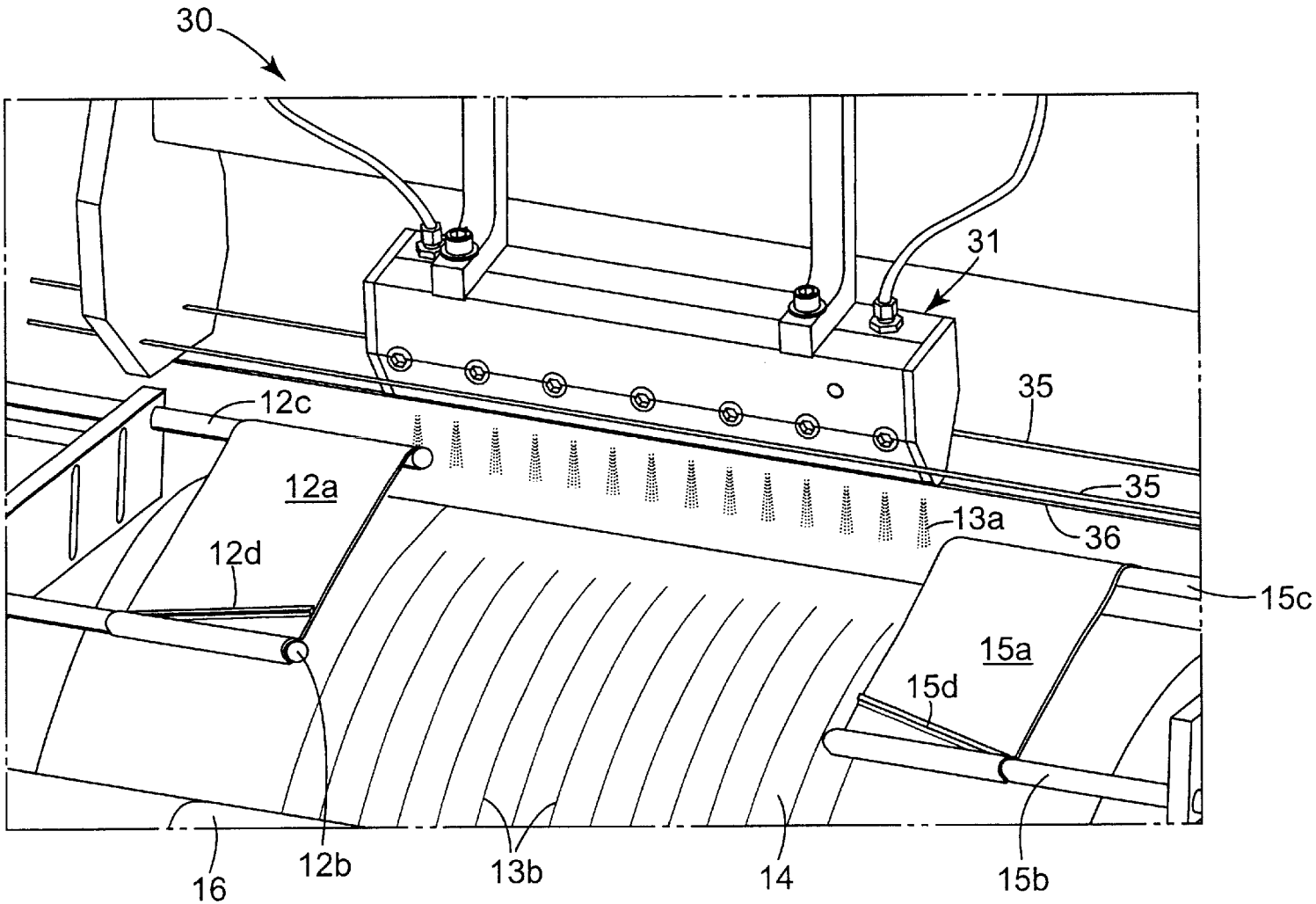
FIG. 1*b* is a perspective view of the electrostatic spray head and conductive transfer surface of the apparatus of FIG. 1*a*.

FIG. 1*b* shows a perspective view of electrostatic spray head 31 and drum 14 of FIG. 1*a* from the upweb side of apparatus 30. Side pan 12*a* is mounted on sliding rods 12*b* and 12*c*, and side pan 15*a* is mounted on sliding rods 15*b* and 15*c*. Side pans 12*a* and 15*a* can be moved together or apart to control coating width. Liquid mists 13*a* extend below wire 36. Excess coating liquid is ducted away by dams 12*d* and 15*d*. If needed, sliding rods, 12*b*, 12*c*, 15*b* and 15*c* can be moved towards each other until they touch and then further pans of varying widths can be added along the rods to produce striped down-web coating patterns.

Figure 1C:
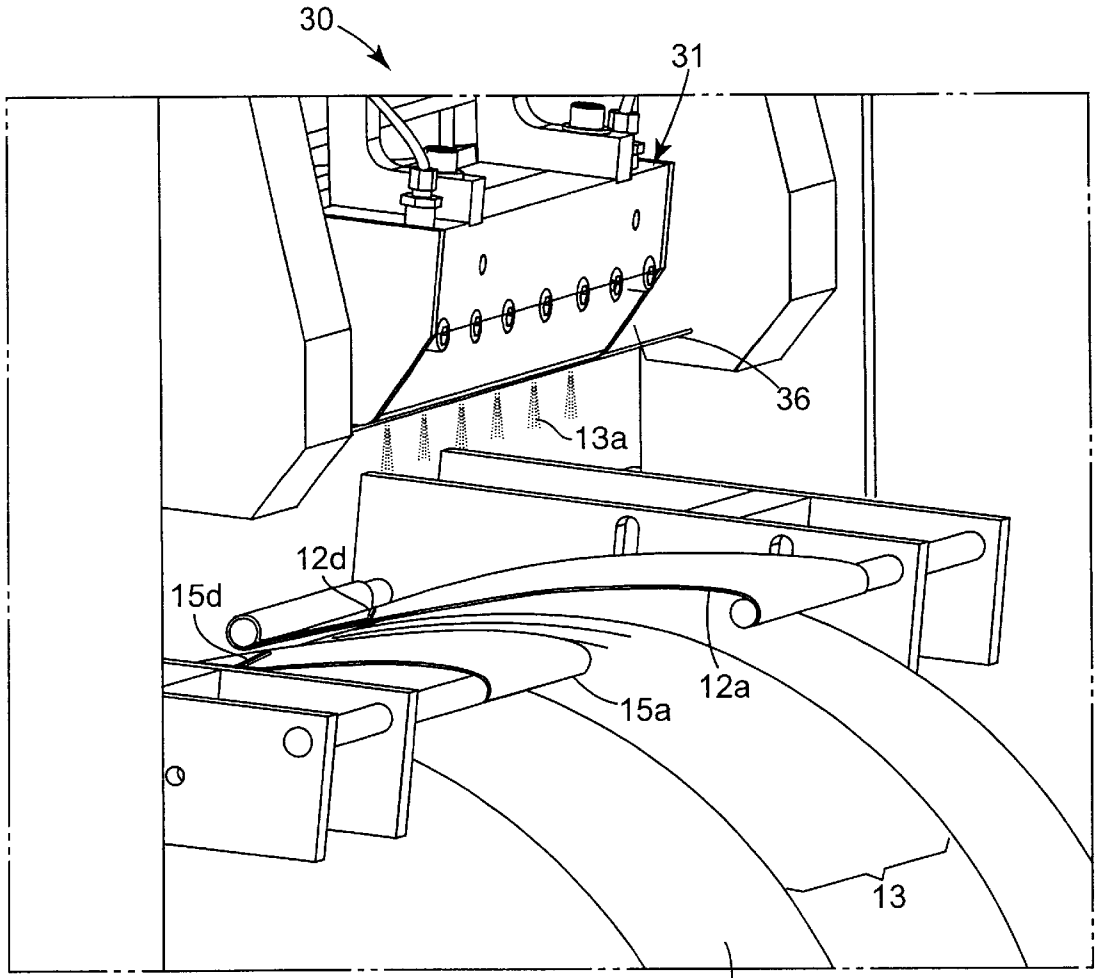
FIG. 1*c* is another perspective view of the electrostatic spray head and conductive transfer surface of the apparatus of FIG. 1*a*.

FIG. 1*c* shows a perspective view of the electrostatic spray head 31 and drum 14 of FIG. 1*a* from the downweb side of apparatus 30. Electrodes 35 have been omitted for clarity. A central stripe on drum 14 is wet with coating liquid 13. Liquid mists 13*a* extend below wire 36, but there are fewer filaments per unit of length along wire 36 than in FIG. 1*b* (and thus fewer mists 13*a*), because the voltage $V_1$ has been reduced in FIG. 1*c*.

Due to the spacing between mists 13*a*, there is a tendency for the drops that land on drum 14 to form regions of high and low coating caliper across drum 14. For thin film coatings the low regions can sometimes be seen as faint stripes 13*b* such as are shown in FIG. 1*b*. After passing nip roll 26 and separation point 18 the stripes are less prominent on the portion of drum 14 between separation point 18 and the target region for the mists 13*a*, as best seen in FIG. 1*c*.

These low caliper regions are further discouraged and the uniformnity of the coating on the target substrate or transfer surface is further improved by altering the electrostatic field during spraying. This alteration can be carried out in a number of ways. For example, for the spray head shown in FIG. 1*a* through FIG. 1*c*, repeated variation in the voltage $V_1$ between the spray head 31 and the drum 14 will visibly change the number and spacing of the mists along the wire 36 and cause the drop pattern to shift back and forth along drum 14 in the cross-web direction. Other ways in which the electrostatic field can be altered during spraying include raising and lowering the electrical potential of drum 14 or other target (e.g., raising the potential above and then returning it to ground), raising and lowering the voltage applied to a nearby field adjusting electrode or second electrostatic spray head, moving a nearby field adjusting electrode or second spray head sufficiently to alter the electrostatic field at the first spray head, or pre-charging the substrate using a pre-charge voltage that is raised and lowered. When two field adjusting electrodes are employed, an asymmetric voltage can be applied to one of the electrodes and the other electrode can be kept at ground or at a different voltage, and then varied during spraying. The particular technique chosen is not critical so long as the drop pattern is suitably changed during spraying. In general, we prefer electrostatic field alteration techniques that do not involve changing the physical location of the spray head with respect to a fixed point in space above the substrate, in order to simplify construction and eliminate a source of potential mechanical wear.

The electrostatic field alteration can be periodic (e.g., a sine wave, square wave or other periodic function) or non-periodic (e.g., alteration based on linear ramp functions in time, random walks and other non-periodic functions). All such alterations appear to be useful. Alterations based on a sine wave or other smooth periodic functions are preferred. A range of frequencies can be employed, from greater than zero up to an upper frequency limit that will depend in part on the composition of the coating liquid and the configuration of the electrostatic spray head, and above which significant changes in the drop pattern may be difficult to achieve.

Figure 2A:
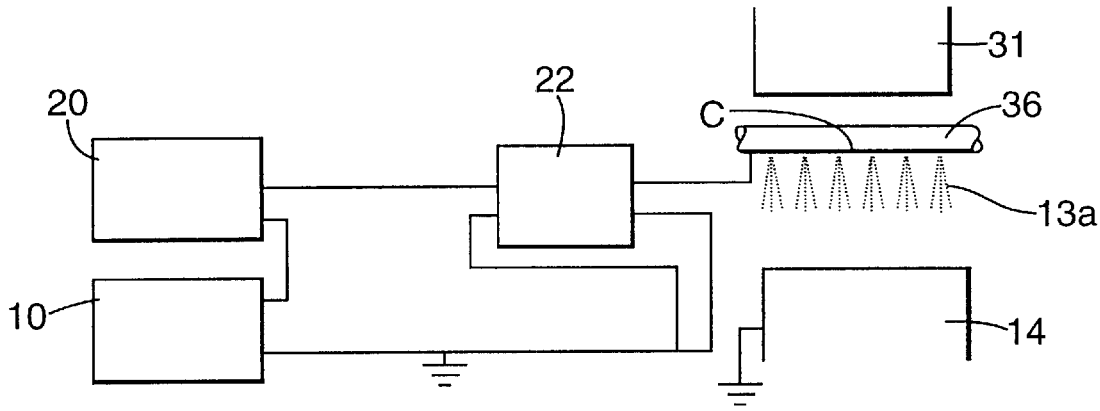
FIG. 2*a* is a circuit that can be used to alter the electrostatic field during spraying.
Figure 2B:
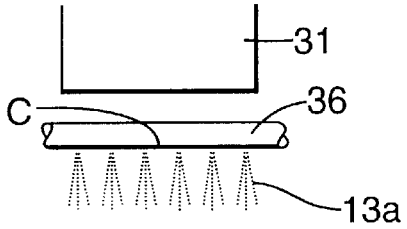
FIG. 2*b* is a schematic input end view of the electrostatic spray head of FIG. 2*a* at high voltage.
Figure 2C:
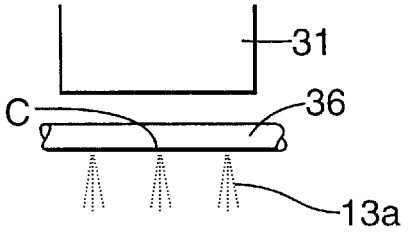
FIG. 2*c* is a schematic input end view of the electrostatic spray head of FIG. 2*a* at low voltage.

FIG. 2*a* illustrates a simple circuit that can be used to alter the voltage applied to the electrostatic spray head. At least one of function generator 10 and direct-current (DC) low-voltage source 20 has an adjustable output voltage. Function generator 10 also has an adjustable output waveform and period. Function generator 10 and source 20 are connected in series to the input of high-voltage power supply 22, and adjusted so that function generator 10 produces a waveform that additively or subtractively changes the total voltage produced across DC low voltage source 20 in series with function generator 10. For example, if high-voltage power supply 22 requires a +10 VDC input to produce a 50 kV output, then function generator 10 can be adjusted to produce an alternating current waveform of about ±1 VAC peak-to-peak and direct current source 20 can be adjusted to produce about +7 VDC. The net effect will be to provide an input signal to supply 22 that periodically varies from about +6 to about +8 VDC, thereby producing a corresponding periodically altered voltage of about 30 to 40 kV between discharge wire 36 and ground. As the voltage changes, the number and spacing of mists 13*a* along wire 36 will change, thereby changing the locations in space at which drops are created relative to a reference point (e.g., the point C in FIG. 2*b* and FIG. 2*c*) on wire 36. The pattern of drops of liquid deposited on the target substrate will likewise change. As shown in FIG. 2*b*, at high voltage the mists 13*a* are relatively numerous and relatively closely spaced along discharge wire 36. As shown in FIG. 2*c*, at low voltage the mists 13*a* are less numerous and less closely spaced along wire 36. As the voltage changes, the mists 13*a* will shift back and forth along wire 36 and produce periodically shifting regions of high and low coating caliper on drum 14. These shifting regions of high and low coating caliper can be evened out much more readily in the improvement station 37 than is the case when the electrostatic field remains fixed and the mists and high and low regions do not change their positions during spraying.

Figure 3:
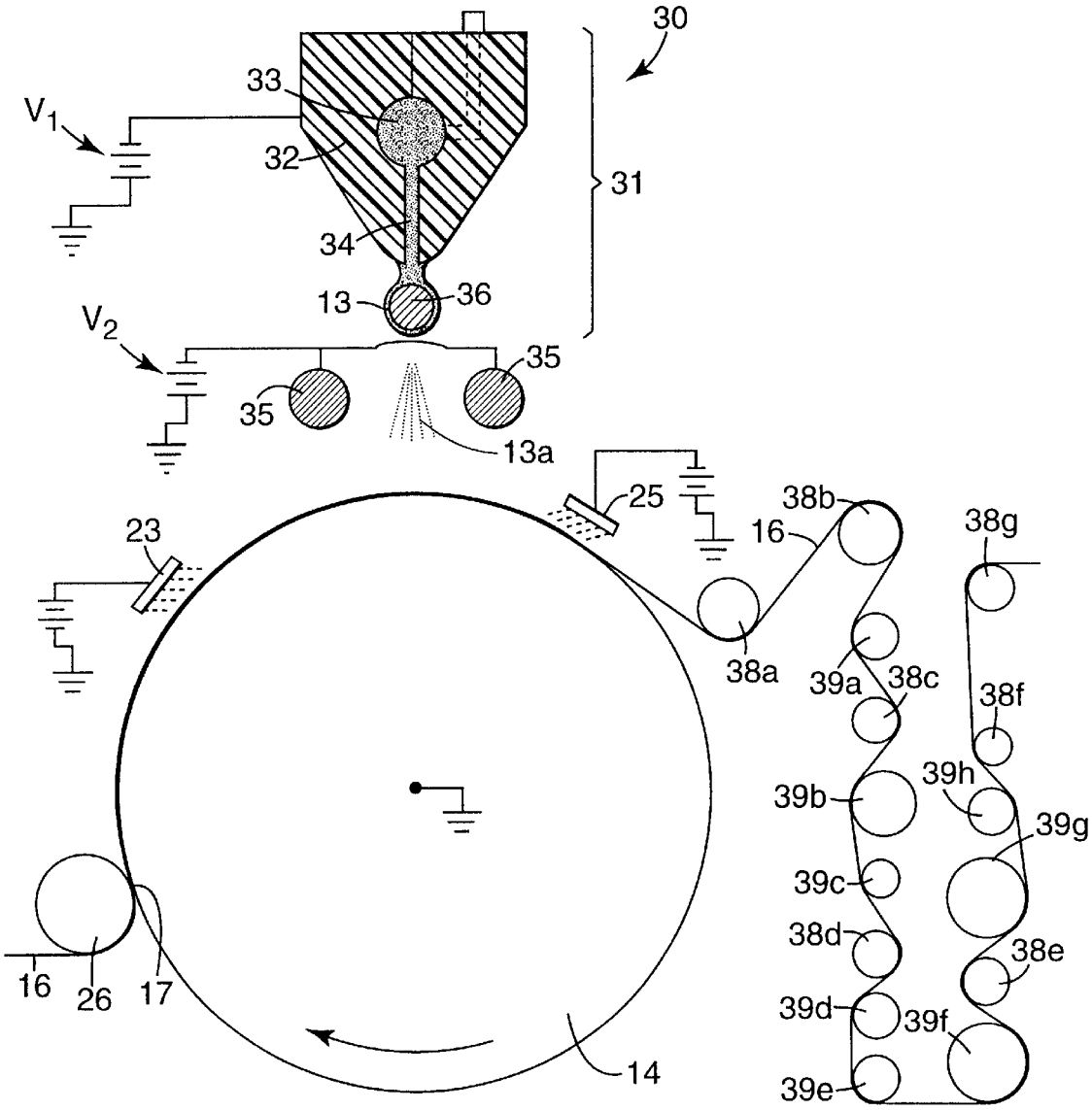
FIG. 3 is a schematic side view, partially in section, of another apparatus of the invention.

In FIG. 3, the apparatus 30 of FIG. 1 has been employed but idler roll 38*a* has been converted to an improvement roll and web 16 has been threaded so that it passes over the top of drum 14. This produces a somewhat less even initial coating than the apparatus shown in FIG. 1*a* through FIG. 1*c*. When coating insulative substrates on the apparatus shown in FIG. 3, electrostatic web pre-charging (depicted at 23 in FIG. 3) usually will be required, post-coating neutralization (depicted at 25 in FIG. 3) preferably will be employed, and an improvement station preferably will be employed.

If desired, web pre-charging can also be employed when using the apparatus shown in FIG. 1*a* through FIG. 1*c*.

However, a significant advantage of the apparatus shown in FIG. 1*a* through FIG. 1*c* is that it can be used to coat insulative and semi-conductive substrates without web pre-charging or post-coating web neutralization.

Figure 4A:
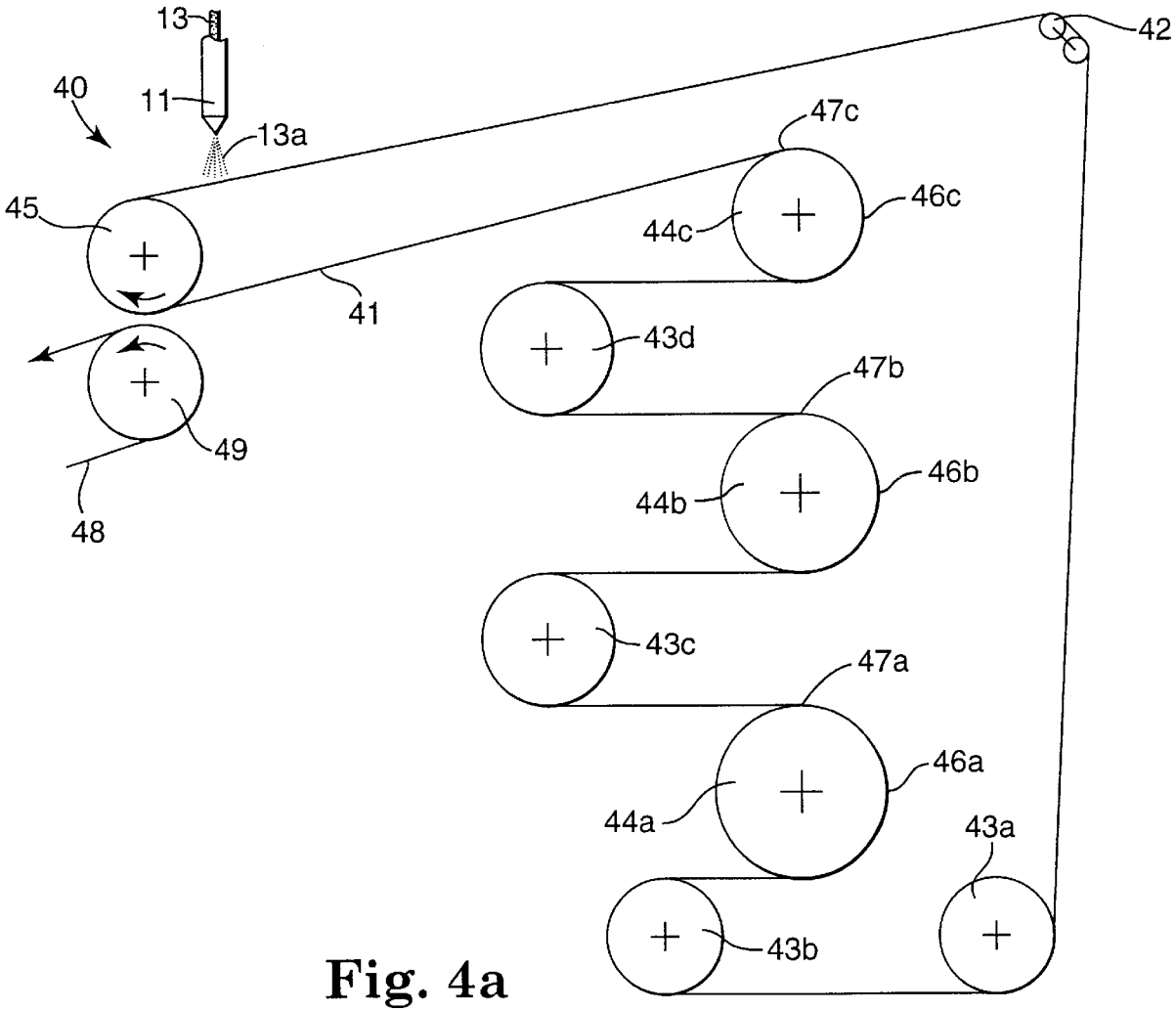
FIG. 4*a* is a schematic side view of an apparatus of the invention equipped with a conductive transfer belt.

FIG. 4*a* shows a coating apparatus of the invention 40 employing electrostatic spray head 11 for dispensing a mist 13*a* of coating liquid 13 onto circulating grounded conductive transfer belt 41. Apparatus 40 utilizes an improvement station to circulate and substantially uniformly coat the conductive transfer surface. Belt 41 (which is made of a conductive material such as a metal band) circulates on steering unit 42; idlers 43*a*, 43*b*, 43*c* and 43*d*; unequal diameter pick-and-place rolls 44*a*, 44*b* and 44*c*; and back-up roll 45. Target web 48 is driven by powered roll 49 and can be brought into contact with belt 41 as belt 41 circulates around back-up roll 45. Pick-and-place rolls 44*a*, 44*b* and 44*c* are undriven and thus co-rotate with belt 41, and have respective relative diameters of, for example, 1.36, 1.26 and 1. The coating on belt 41 contacts the surfaces of pick-and-place rolls 44*a*, 44*b* and 44*c* at the liquid-filled nip regions 46*a*, 46*b* and 46*c*. The liquid coating splits at the separation points 47*a*, 47*b* and 47*c*, and a portion of the coating remains on the pick-and-place rolls 44*a*, 44*b* and 44*c* as they rotate away from the separation points 47*a*, 47*b* and 47*c*. The remainder of the coating travels onward with belt 41. Down-web variations in the coating caliper just prior to the separation points 47*a*, 47*b* and 47*c* will be mirrored in both the liquid caliper variation on belt 41 and on the surfaces of the pick-and-place rolls 44*a*, 44*b* and 44*c* as they leave separation points 47*a*, 47*b* and 47*c*. Following further movement of belt 41, the liquid on the pick-and-place rolls 44*a*, 44*b* and 44*c* will be redeposited on belt 41 in new positions along belt 41.

Following startup of apparatus 40 and a few rotations of belt 41, belt 41 and the surfaces of rolls 44*a*, 44*b* and 44*c* will become coated with a substantially uniform wet layer of liquid 13. Once belt 41 is coated with liquid, there will no longer be a three phase (air, coating liquid and belt) wetting line at the region in which the applied atomized drops of coating liquid 13 reach belt 41. This makes application of the coating liquid 13 much easier than is the case for direct coating of a dry web.

When rolls 45 and 49 are nipped together, a portion of the wet coating on belt 41 is transferred to target web 48. Since only about one half the liquid is transferred at the 45, 49 roll nip, the percentage of caliper non-uniformity on belt 41 in the region immediately downstream from the spray head 11 will generally be much smaller (e.g., by as much as much as half an order of magnitude) than when coating a dry web without a transfer belt and without passing the thus-coated web through an improvement station having the same number of rolls. In steady state operation coating liquid 13 is added to belt 41 by spray head 11 at the same average rate that the coating is transferred to target web 48.

Although a speed differential can be employed between belt 41 and any of the other rolls shown in FIG. 4*a*, or between belt 41 and web 48, we prefer that no speed differential be employed between belt 41 and pick-and-place rolls 44*a*, 44*b* and 44*c*, or between belt 41 and web 48. This simplifies the mechanical construction of apparatus 40.

Figure 4B:
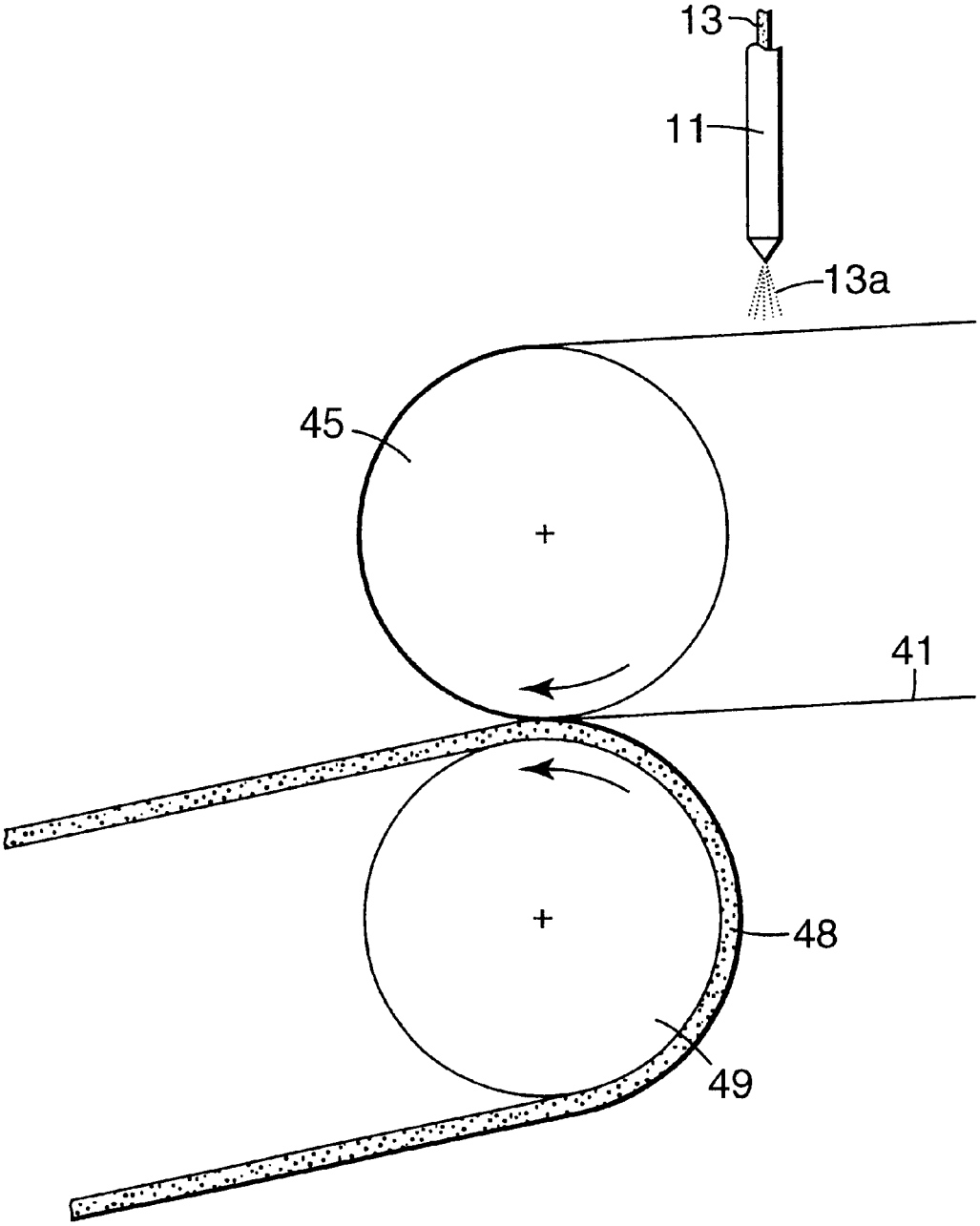
FIG. 4*b* is a magnified side view of a portion of the apparatus of FIG. 4*a* and a porous web.

FIG. 4*b* shows a magnified view of rolls 45 and 49 of FIG. 4*a*. As illustrated in FIG. 4*b*, target web 48 is porous. Target web 48 can also be non-porous if desired. Through suitable adjustment of the nip pressure, penetration of the wet coating into the pores of a porous target web can be controlled and limited to the upper surface of the porous web, without penetration to the other surface of the web and preferably without penetration to the inner portion of the web. In contrast, when conventional electrostatic or other spray coating techniques are used for direct coating of a porous web, the applied atomized drops frequently penetrate into and sometimes completely through the pores of the web. This is especially true for woven webs with a large weave pattern or for nonwoven webs with a substantial void volume.

Figure 5A:
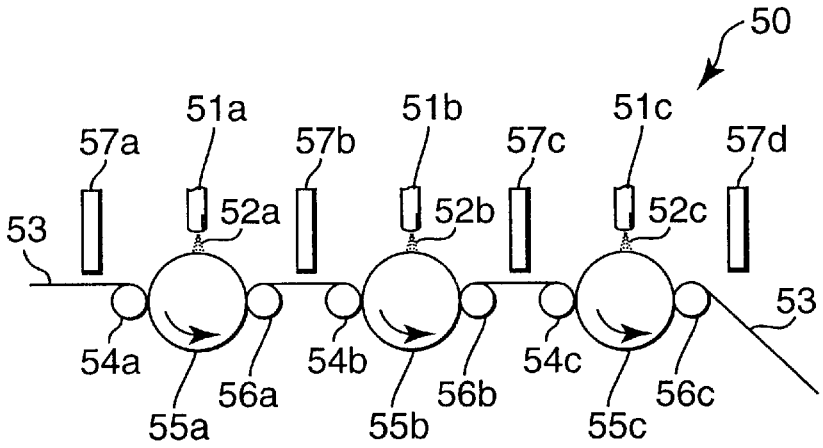
FIG. 5*a* is a schematic side view of an apparatus of the invention equipped with a series of electrostatic spray heads and conductive drums.
Figure 5B:
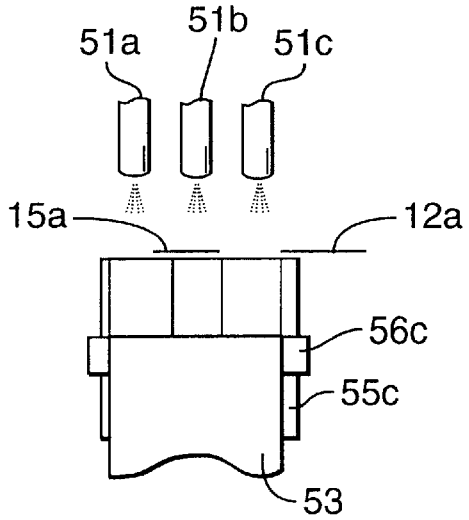
FIG. 5*b* is a schematic end view of the apparatus of FIG. 5*a*, set up to spray coating stripes in adjacent lanes.

FIG. 5*a* and FIG. 5*b* respectively show side and end schematic views of an apparatus 50 of the invention that can apply stripes of coatings to a web in adjacent, overlapping or separate lanes. A series of electrostatic spray heads 51*a*, 51*b* and 51*c* apply mists 52*a*, 52*b* and 52*c* of liquids to web 53, at positions that are spaced laterally across the width of web 53. Web 53 passes over nip rolls 54*a*, 54*b* and 54*c*5, under rotating conductive drums 55*a*, 55*b* and 55*c*, and over take-off rolls 56*a*, 56*b* and 56*c*. Ground plates 57*a*, 57*b*, 57*c* and 57*d* help discourage electrostatic interference between the electrostatic spray heads 51*a*, 51*b* and 51*c*, or if desired can be subjected to changing voltages in order to cause such interference and alter one or more of the applicable electrostatic fields. Drum 55*b* serves as an improvement station roll for the coating applied at drum 55*a*, and drum 55*c* serves as an improvement station roll for the coatings applied at drums 55*a* and 55*b*.

As shown in FIG. 5*b*, electrostatic spray heads 51*a*, 51*b* and 51*c* have been set up to apply stripes of the coatings in lanes. Those skilled in the art will appreciate that electrostatic spray heads 51*a*, 51*b* and 51*c* can be spaced at other lateral positions and that side pans or other masking devices such as side pans 12*a* and 15*a* (for clarity, only one of each is shown in FIG. 5*b*) over drum 55*c* can be employed and adjusted to control the lateral positions and widths of each coating stripe. Thus the coating stripes can wholly or partially overlap, abut one another, or be separated by stripes of uncoated web as desired. Those skilled in the art will also appreciate that electrostatic spray heads 51*a*, 51*b* and 51*c* can contain different coating chemistries, so that several different chemistries can be contemporaneously coated across web 53.

Figure 5C:
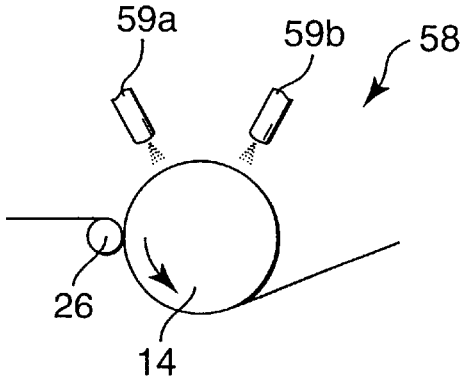
FIG. 5*c* is a schematic side view of an apparatus of the invention equipped with a series of electrostatic spray heads and a single conductive drum.

FIG. 5*c* shows a side schematic view of an apparatus 58 of the invention that can apply stripes of the coatings in lanes, using a single rotating conductive drum 14 or other transfer surface and a plurality of electrostatic spray heads 59*a* and 59*b*. As with apparatus 50 of FIG. 5*a* and FIG. 5*b*, electrostatic spray heads 59*a* and 59*b* of apparatus 58 can be spaced at various lateral positions and side pans or other masking devices can be employed and adjusted to control the lateral positions and widths of each coating stripe. Thus the coating stripes produced by apparatus 58 can wholly or partially overlap, abut one another, or be separated by stripes of uncoated web as desired. If electrostatic spray heads 59*a* and 59*b* are placed sufficiently close to one another, then alteration in the electrostatic field at one of electrostatic spray heads 59*a* or 59*b* can cause an alteration in the electrostatic field at the other spray head 59*b* or 59*a* and change the patterns of drops produced by both spray heads.

Two or more spray heads can be positioned over the transfer surface (e.g., over the drum 14 in FIG. 5*c*) and arranged to deposit two or more liquids into the same lane. This will enable mixing and application of unique compositional variations or layered coatings. For example, some solventless silicone formulations employ two immiscible chemicals. These may include two different acrylated polysiloxanes that will turn cloudy when mixed, and will separate into two or more phases if allowed to stand undisturbed for a sufficient period of time. Also, many epoxy-silicone polymer precursors and other polymerizable formulations contain a liquid catalyst component that is immiscible with the rest of the formulation. By spraying these formulation components sequentially from successive nozzles, we can manipulate the manner in which the components are blended and the downweb component concentrations and thicknesses. Through the combined use of sequentially arranged spray heads followed by passage of the applied coating through an improvement station, we can achieve repeated separation and recombining of the components. This is especially useful for difficult to mix or rapid reaction formulations.

If desired, an inert or a non-inert atmosphere can be used to prevent or to encourage a reaction by the drops as they travel from the spray head or spray heads to the substrate or transfer surface. Also, the substrate or transfer surface can be heated or cooled to encourage or to discourage a reaction by the applied liquid.

For a periodically electrically altered electrostatic field and a pattern of drops applied to a rotating drum, the invention can be further understood through calculations that relate the period of alteration to the rotational radian frequency of the drum. If a varying voltage V having a period $\tau$ is applied to a typical electrostatic spray device, then the spray pattern will also vary with period $\tau$. Such an electrostatic spray device can be used to deposit a coating onto rotating drum having a radius $R_D$ and moving at surface speed S, and thence to transfer the coating to a moving web wrapped under the drum. We will assume that the web and the drum surface move at the same speed or at nearly the same speed. A point on the drum surface will move a small distance ds in a small time dt such that $S=ds/dt$. The rotation of a point on the drum can be conveniently described using a cylindrical coordinate system in which the central axis of the drum and the origin of the coordinate system coincide. Two lines can be drawn perpendicular to the central axis, with the first line being fixed in space. The second line can be drawn from the central axis to a fixed point on the drum surface such that the second line rotates in space with the drum. An angle $\theta$ can be used to define the angle between the two lines. For this situation as the drum turns the angle $\theta$ will move from $\theta$ at time t to $\theta+d\theta$ at time t+dt. A point on the surface of the drum will move a distance ds in this time dt. The distance ds is also defined by the arc length $R_D d\theta$. As a result $ds=R_D d\theta=R_D d\theta(dt/dt)=R_D(d\theta/dt)dt=R_D\omega_D dt$ where $\omega_D=d\theta/dt$ is the radian rotational frequency of the drum. Accordingly, $S=ds/dt=R_D\omega_D$ relates the web speed S to the drum radius $R_D$ and the rotational radian frequency $\omega_D$ of the drum. Likewise, if $\theta=0$ at time t=0, then the roll will make a single complete revolution when $\theta=2\pi$. If the time to make this single revolution is defined as the period of rotation time $\tau_D$ then since $d\theta=\omega_D dt$, it follows that $2\pi=\omega_D\tau_D$. That is to say, the radian frequency is related to the period by $\omega_D=2\pi/\tau_D$.

This concept of relating a radian frequency to its period is a general concept that can be applied to devices that operate repetitively in time. Thus if a mist is made to oscillate its pattern of drops with a period $\tau$ then its radian frequency $\omega$ is related to its period $\tau$ by $\omega=2\pi/\tau$. If such a mist is allowed to vary cross web with a period $\tau$, then the radian frequency of the oscillating spray will be $\omega=2\pi/\tau$. If the period of the oscillating spray is made longer than the period $\tau_D$ required for the drum to make one revolution, then the drum will make a complete revolution in less time than it takes for one full oscillation of the mist pattern. Although it may take several revolutions, eventually the mist will repeat the coating pattern deposited on a specific location on the drum. The coating pattern is repeated when $I_L\tau_D=I_S\tau$ where $I_S$ and $I_L$ are integers, $I_S$ being the smaller integer and $I_L$ being the larger integer. Since $\tau_D$ is the time to make one revolution of the drum, $I_L$ will be the number of drum revolutions needed before the spray pattern is identically repeated on the drum. Likewise, $I_S$ will be the number of periods of the spray pattern required before the spray pattern repeats itself on the drum. A similar argument can be made when the periods are reversed. Namely, when $\tau_D$ is greater than $\tau$ it means the coating pattern will be repeated when $I_S\tau_D=I_L\tau$ where $I_S$ and $I_L$ are integers, $I_S$ being the smaller integer and $I_L$ being the larger integer. Since $\tau_D$ is the time to make one revolution of the drum, $I_S$ will for this situation represent the number of drum revolutions needed before the spray pattern is repeated on the drum. Likewise, $I_L$ will represent the number of periods of the spray pattern required before the spray pattern repeats itself on the drum.

The actual number of revolutions required for a repeat of the coating pattern can be determined once we know whether $\tau_D$ is less than or greater than the spray pattern period $\tau$. In either situation the procedure is the same. For example, consider the situation where the drum rotation time $\tau_D$ is less than the spray pattern period $\tau$ so that the criteria $I_L\tau_D=I_S\tau$ must be satisfied. If the radius $R_D$ of the drum is known and the period $\tau$ of the oscillation of the mist is measured, then the ratio $\tau/\tau_D=I_L/I_S=[\tau/(2\pi R_D)]S=N$ where N is a number, but not necessarily an integer. The requirement for a repeat spray pattern appearing on the drum reduces to $\tau/\tau_D=I_L/I_S=N$, or simply $NI_S=I_L$. To determine a value for the integer $I_S$ we can list the integers 1, 2, 3, . . . n down a column in a spreadsheet. In the next column in the corresponding cell we multiply each integer by N. The first row for which the product in the second column provides an integer result will thereby yield a value for $I_L$. Alternatively, if X is any number, since $X-INT(X)=0$ only when X is an integer, we could also let $I_i$ be the ith integer, (i.e., $I_1=1$, $I_2=2$, $I_3=3$, . . . $I_i=i$, . . . $I_n=n$) in the first column of the spreadsheet and place in the corresponding cell in the second column of the spreadsheet the value $NI_i-INT(NI_i)$. When the value is equal to zero then the corresponding integer in the first column represents $I_S$. In either case, once either $I_S$ or $I_L$ is determined by the alternative methods just discussed, the other integer can be obtained from $I_L/I_S=N$ since N is already known. As a result it is possible to determine the number of revolutions of the drum required and the number of periods of the spray pattern required before the spray pattern repeats itself on the drum.

Figure 6:
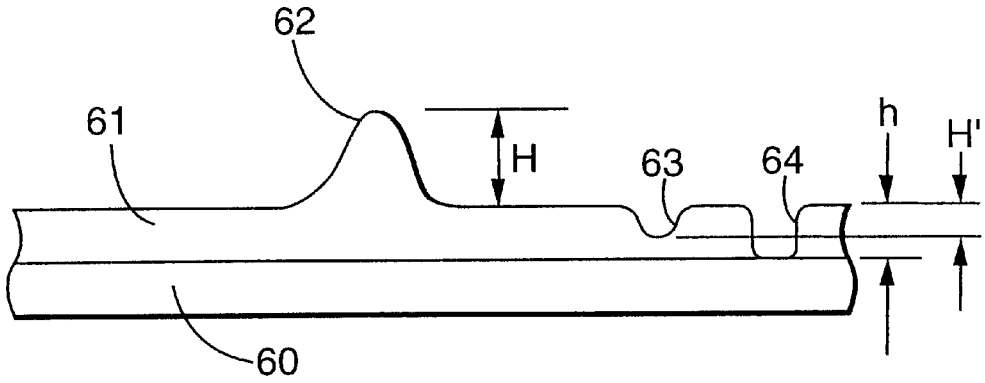
FIG. 6 is a schematic side view of coating defects on a web.

As mentioned above, the method and apparatus of the invention can employ an improvement station comprising two or more pick-and-place devices that improve the uniformity of the coating in a second direction. For methods involving coating a moving web and changing the drop pattern in the cross-web direction, this second direction typically is the down-web direction. The improvement station is described in the above-mentioned copending U.S. patent application Ser. No. 09/757,955 and can be further explained as follows. Referring to FIG. 6, a coating of liquid 61 of nominal caliper or thickness h is present on a substrate (in this instance, a continuous web) 60. If a random local spike 62 of height H above the nominal caliper is deposited for any reason, or if a random local depression (such as partial cavity 63 of depth H' below the nominal caliper, or void 64 of depth h) arises for any reason, then a small length of the coated substrate will be defective and not useable. The improvement station brings the coating-wetted surfaces of two or more pick-and-place improvement devices (not shown in FIG. 6) into periodic (e.g., cyclic) contact with coating 61. This permits uneven portions of the coating such as spike 62 to be picked off and placed at other positions on the substrate, or permits coating material to be placed in uneven portions of the coating such as cavity 63 or void 64. The placement periods of the pick-and-place devices are chosen so that their actions do not reinforce coating defects along the substrate. The pick-and-place devices can if desired be brought into contact with the coating only upon appearance of a defect. Alternatively, the pick-and-place devices can contact the coating whether or not a defect is present at the point of contact.

Figure 7:
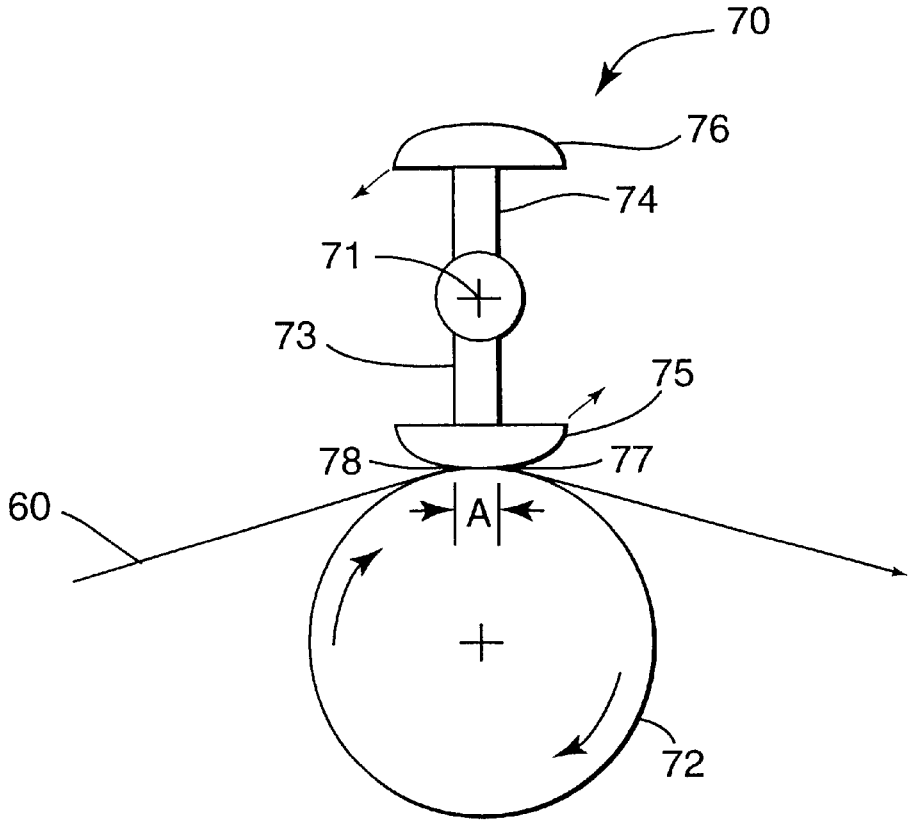
FIG. 7 is a schematic side view of a pick-and-place device.

A type of pick-and-place device 70 that can be used in the present invention to improve a coating on a moving web 60 is shown in FIG. 7. Device 70 has a central hub 71 about which device 70 can rotate. The device 70 extends across the coated width of the moving web 60, which is transported past device 70 on roll 72. Extending from hub 71 are two radial arms 73 and 74 to which are attached pick-and-place surfaces 75 and 76. Surfaces 75 and 76 are curved to produce a singular circular arc in space when device 70 rotates. Because of their rotation and spatial relation to the web 60, pick-and-place surfaces 75 and 76 periodically contact web 60 opposite roll 72. Wet coating (not shown in FIG. 7) on web 60 and surfaces 75 and 76 fills a contact zone of width A on web 60 from starting point 78 to separation point 77. At the separation point, some liquid stays on both web 60 and surface 75 as the pick-and-place device 70 continues to rotate and web 60 translates over roll 72. Upon completing one revolution, surface 75 places a portion of the liquid at a new longitudinal position on web 60. Web 60 meanwhile will have translated a distance equal to the web speed multiplied by the time required for one rotation of the pick-and-place surface 75. In this manner, a portion of a liquid coating can be picked up from one web position and placed down on a web at another position and at another time. Both the pick-and-place surfaces 75 and 76 produce this action.

The period of a pick-and-place device can be expressed in terms of the time required for the device to pick up a portion of wet coating from one position along a substrate and then lay it down on another position, or by the distance along the substrate between two consecutive contacts by a surface portion of the device. For example, if the device 70 shown in FIG. 7 is rotated at 60 rpm and the relative motion of the substrate with respect to the device remains constant, then the period is one second.

A plurality of pick and place devices having two or more, and more preferably three or more different periods, are employed. Most preferably, pairs of such periods are not related as integer multiples of one another. The period of a pick-and-place device can be altered in many ways. For example, the period can be altered by changing the diameter of a rotating device; by changing the speed of a rotating or oscillating device; by repeatedly (e.g., continuously) translating the device along the length of the substrate (e.g., up web or down web) with respect to its initial spatial position as seen by a fixed observer; or by changing the translational speed of the substrate relative to the speed of rotation of a rotating device. The period does not need to be a smoothly varying function, and does not need to remain constant over time.

Many different mechanisms can produce a periodic contact with the liquid coated substrate, and pick-and-place devices having many different shapes and configurations can be employed. For example, a reciprocating mechanism (e.g., one that moves up and down) can be used to cause the coating-wetted surfaces of a pick-and-place device to oscillate into and out of contact with the substrate. Preferably the pick-and-place devices rotate, as it is easy to impart a rotational motion to the devices and to support the devices using bearings or other suitable carriers that are relatively resistant to mechanical wear.

Although the pick-and-place device shown in FIG. 7 has a dumbbell shape and two noncontiguous contacting surfaces, the pick-and-place device can have other shapes, and need not have noncontiguous contacting surfaces. Thus as already shown in FIG. 1*a*, FIG. 3 and FIG. 4*a*, the pick-and-place devices can be a series of rolls that contact the substrate, or an endless belt whose wet side contacts a series of wet rolls and the substrate, or a series of belts whose wet sides contact the substrate, or combinations of these. These rotating pick-and-place devices preferably remain in continuous contact with the substrate.

Improvement stations employing rotating rolls are preferred for coating moving webs or other substrates having a direction of motion. The rolls can rotate at the same peripheral speed as the moving substrate, or at a lesser or greater speed. If desired, the devices can rotate in a direction opposite to that of the moving substrate. Preferably, at least two of the rotating pick-and-place devices have the same direction of rotation and are not periodically related. More preferably, for applications involving the improvement of a coating on a web or other substrate having a direction of motion, the direction of rotation of at least two such pick-and-place devices is the same as the direction of substrate motion. Most preferably, such pick-and-place devices rotate in the same direction as and at substantially the same speed as the substrate. This can conveniently be accomplished by using corotating undriven rolls that bear against the substrate and are carried with the substrate in its motion.

When initially contacting the coating with a pick-and-place device like that shown in FIG. 7, a length of defective material is produced. At the start, the pick-and-place transfer surfaces 75 and 76 are dry. At the first contact, device 70 contacts web 60 at a first position on web 60 over a region A. At the separation point 77, roughly half the liquid that entered region A at the starting point 78 will wet the transfer surface 75 or 76 with coating liquid and be removed from the web. This liquid splitting creates a spot of low and defective coating caliper on web 60 even if the entering coating caliper was uniform and equal to the desired average caliper. When the transfer surface 75 or 76 re-contacts web 60 at a second position, a second coating liquid contact and separation occurs, and a second defective region is created. However, it will be less deficient in coating than the first defective region. Each successive contact produces smaller defective regions on the web with progressively smaller deviations from the average caliper until equilibrium is reached. Thus, the initial contacting produces periodic variations in caliper for a length of time. This represents a repeating defect, and by itself would be undesirable.

There is no guarantee that the liquid split ratio between the web and the surface will remain always at a constant value. Many factors can influence the split ratio, but these factors tend to be unpredictable. If the split ratio changes abruptly, a periodic down web caliper variation will result even if the pick-and-place device has been running for a long time. If foreign material lodges on a transfer surface of the pick-and-place device, the device may create a periodic down web defect at each contact. Thus, use of only a single pick-and-place device can potentially create large lengths of scrap material.

The improvement station employs two or more, preferably three or more, and more preferably five or more or even eight or more pick-and-place devices in order to achieve good coating uniformity. After the coating liquid on the pick-and-place transfer surfaces has built to an equilibrium value, a random high or low coating caliper spike may pass through the station. When this happens, and if the defect is contacted, then the periodic contacting of the web by a single pick-and-place device, or by an array of several pick-and-place devices having the same contact period, will repropagate a periodic down web defect in the caliper. Again, scrap will be generated and those skilled in coating would avoid such an apparatus. It is much better to have just one defect in a coated web rather than a length of web containing multiple images of the original defect. Thus a single device, or a train of devices having identical or reinforcing periods of contact, can be very detrimental. However, a random initial defect entering the station or any defect generated by the first contacting can be diminished by using an improvement station comprising more than two pick and place devices whose periods of contact are selected to reduce rather than repropagate the defect. Such an improvement station can provide improved coating uniformity rather than extended lengths of defective coating, and can diminish input defects to such an extent that the defects are no longer objectionable.

By using the above-described electrostatic spray head and an improvement station in combination, a new down web coating profile can be created at the exit from the improvement station. That is, by using multiple pick-and-place devices we can modify defects in the coating applied by the electrostatic spray head. These defects will be repropagated as defect images by the first device in the improvement station and modified by additional defect images that are propagated and repropagated from the second and any subsequent devices. We can do this in a constructively and destructively additive manner so that the net result is near uniform caliper or a controlled caliper variation. We in effect create multiple waveforms that are added together in a manner so that the constructive and destructive addition of each waveform combines to produce a desired degree of uniformity. Viewed somewhat differently, when a coating upset passes through the improvement station a portion of the coating from the high spots is in effect picked off and placed back down in the low spots.

Figure 8:
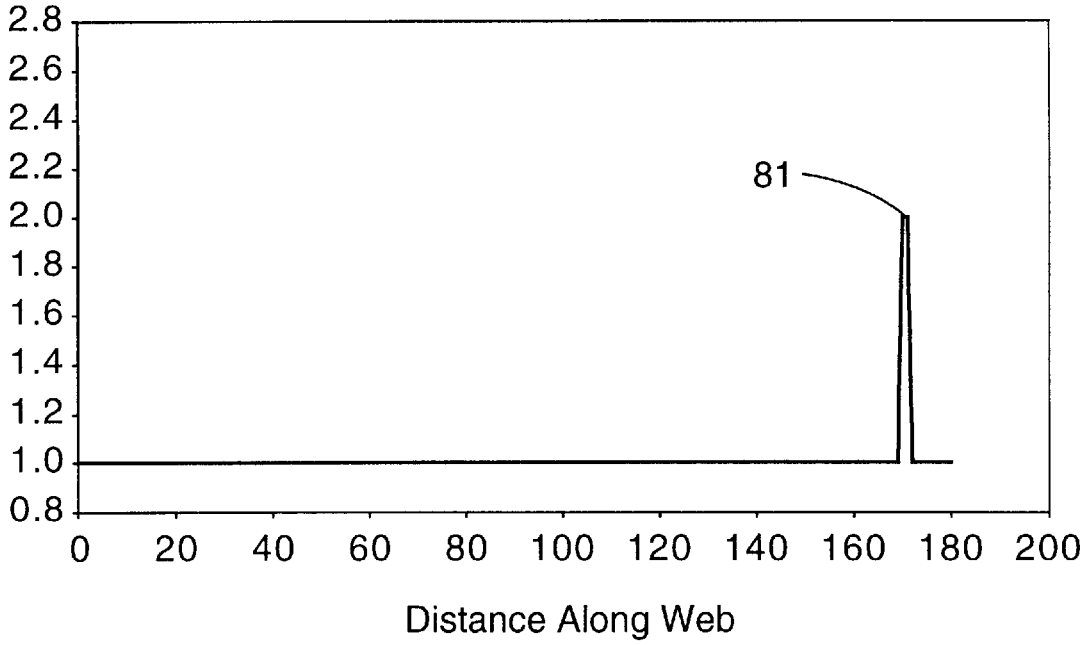
FIG. 8 is a graph of coating caliper vs. web distance for a single large caliper spike on a web.

Mathematical modeling of our improvement process is helpful in gaining insight and understanding. The modeling is based on fluid dynamics, and provides good agreement to observable results. FIG. 8 shows a graph of liquid coating caliper vs. lengthwise (machine direction) distance along a web for a solitary random spike input 81 located at a first position on the web approaching a periodic contacting pick-and-place transfer device (not shown in FIG. 8). FIG. 9 through FIG. 13 show mathematical model results illustrating the liquid coating caliper along the web when spike input 81 encounters one or more periodic pick-and-place contacting devices.

Figure 9:
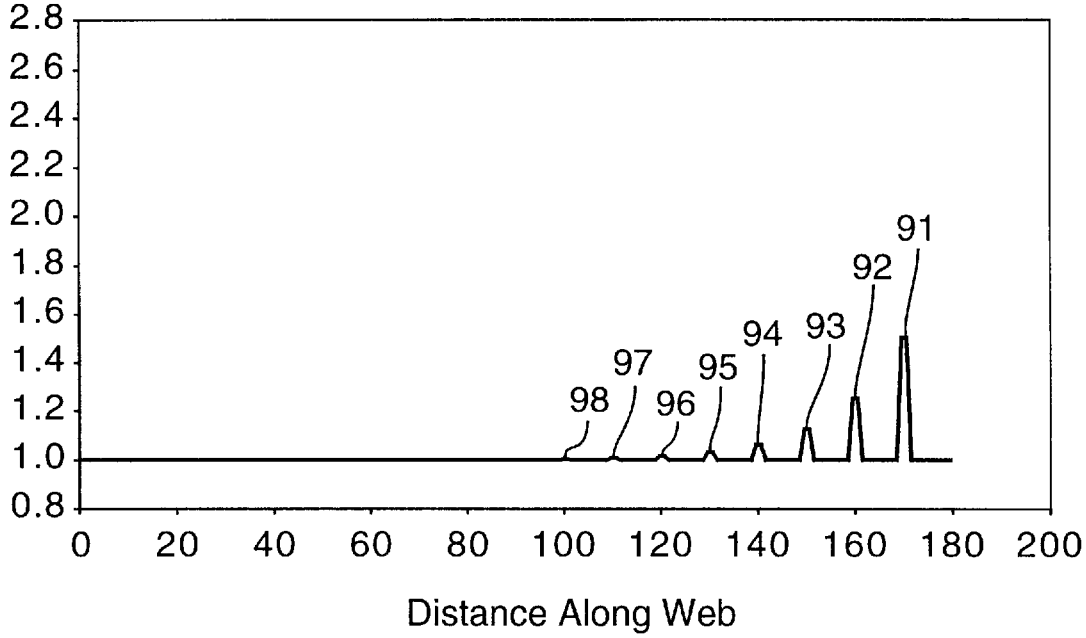
FIG. 9 is a graph of coating caliper vs. web distance when the spike of FIG. 8 encounters a single periodic pick-and-place device having a period of 10.

FIG. 9 shows the amplitude of the reduced spike 91 that remains on the web at the first position and the repropagated spikes 92, 93, 94, 95, 96, 97 and 98 that are placed on the web at second and subsequent positions when spike input 81 encounters a single periodic pick-and-place contacting device. The peak of the initial input spike 81 is one length unit long and two caliper units high. The contacting device period is equivalent to ten length units. The images of the input defect are repeated periodically in 10 length unit increments, over a length longer than sixty length units. Thus, the length of defectively coated or "reject" web is greatly increased compared to the length of the input defect. The exact defective length, of course, depends on the acceptable coating caliper variability for the desired end use.

Figure 10:
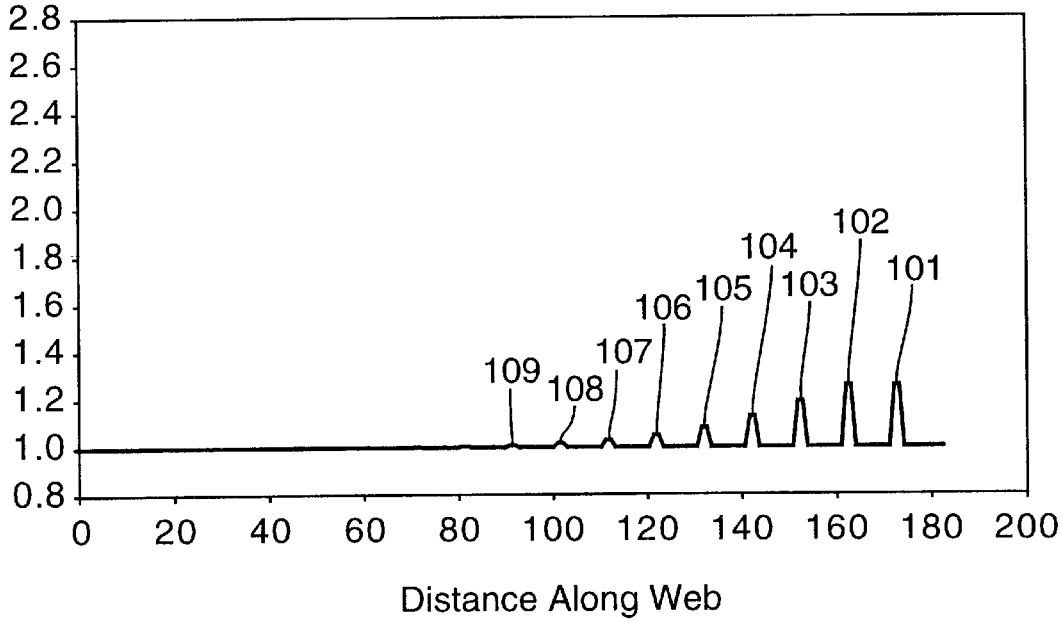
FIG. 10 is a graph of coating caliper vs. web distance when the spike of FIG. 8 encounters two periodic pick-and-place devices having a period of 10.

FIG. 10 shows the amplitude of the reduced spike 101 that remains on the web at the first position and some of the repropagated spikes 102, 103, 104, 105, 106, 107, 108 and 109 that are placed on the web at second and subsequent positions when spike input 81 encounters two periodic, sequential, synchronized pick-and-place transfer devices each having a period of 10 length units. Compared to the use of a single periodic pick-and-place device, a lower amplitude spike image occurs over a longer length of the web.

Figure 11:
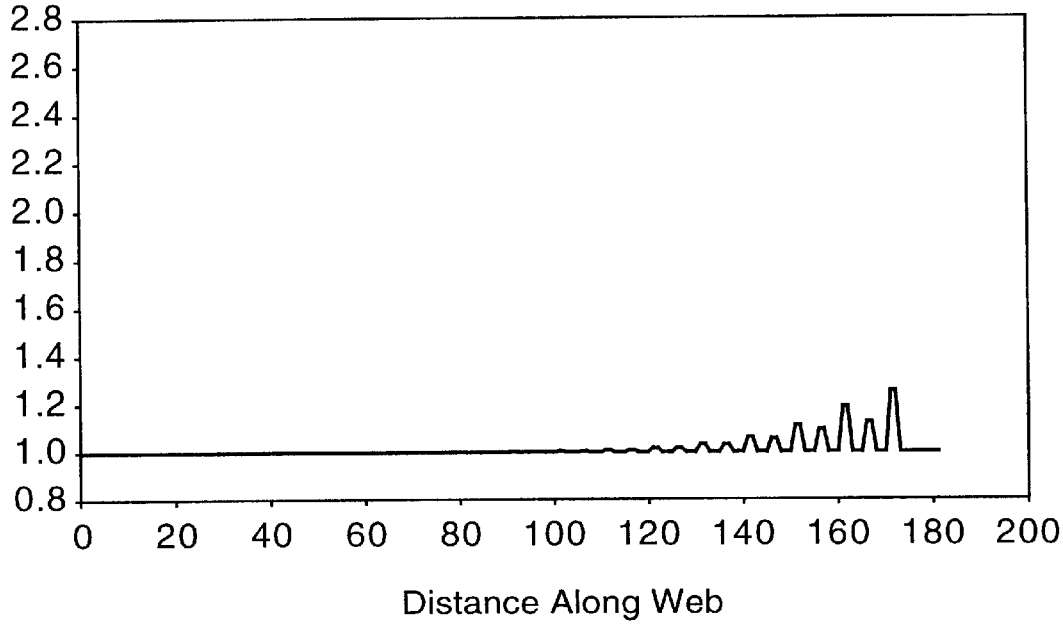
FIG. 11 is a graph of coating caliper vs. web distance when the spike of FIG. 8 encounters two periodic pick-and-place devices having periods of 10 and 5, respectively.

FIG. 11 shows the coating that results when two periodic, sequential, synchronized contacting devices having periods of 10 and then 5 are used. These devices have periodically related contacting periods. Their pick-and-place action will deposit coating at periodically related positions along the web. Compared to FIG. 10, the spike image amplitude is not greatly reduced but a somewhat shorter length of defective coated web is produced.

Figure 12:
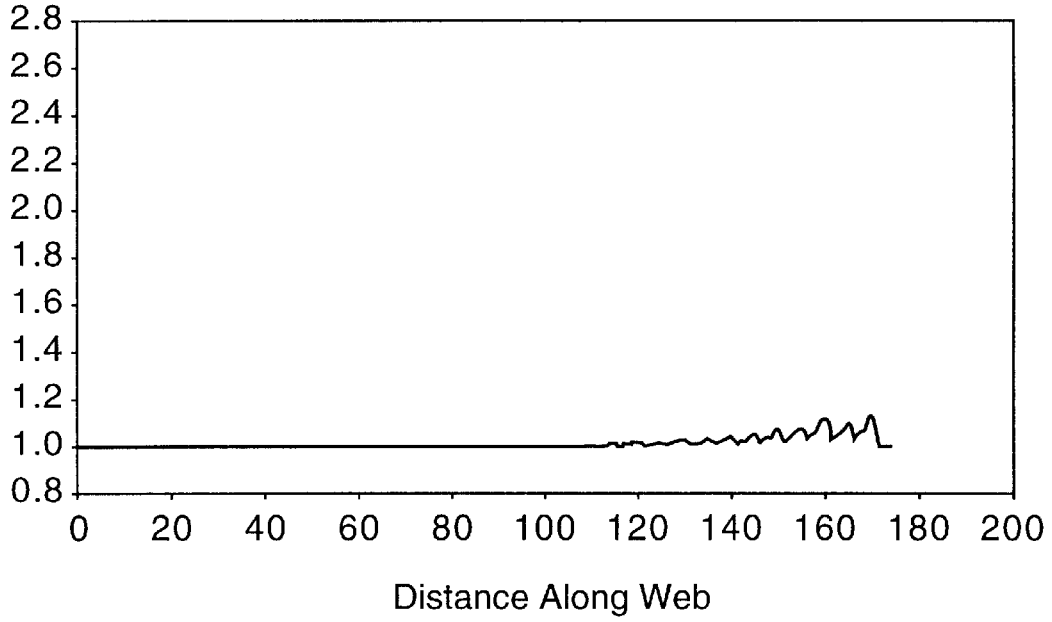
FIG. 12 is a graph of coating caliper vs. web distance when the spike of FIG. 8 encounters three periodic pick-and-place devices having periods of 10, 5 and 2, respectively.

FIG. 12 shows the coating that results when three periodic pick-and-place devices having different periods of 10, 5 and 2 are used. The device with a period of 10 and the device with a period of 5 are periodically related. The device with a period of 10 and the device with a period of 2 are also periodically related. However, the device with a period of 5 and the device with a period of 2 are not periodically related (because 5 is not an integer multiple of 2), and thus this train of devices includes first and second periodic pick-and-place devices that can contact the coating at a first position on the web and then re-contact the coating at second and third positions on the web that are not periodically related to one another with respect to their distance from the first position. Compared to the devices whose actions are shown in FIG. 9 through FIG. 11, much lower caliper deviations and much shorter lengths of defective coated web are produced.

Figure 13:
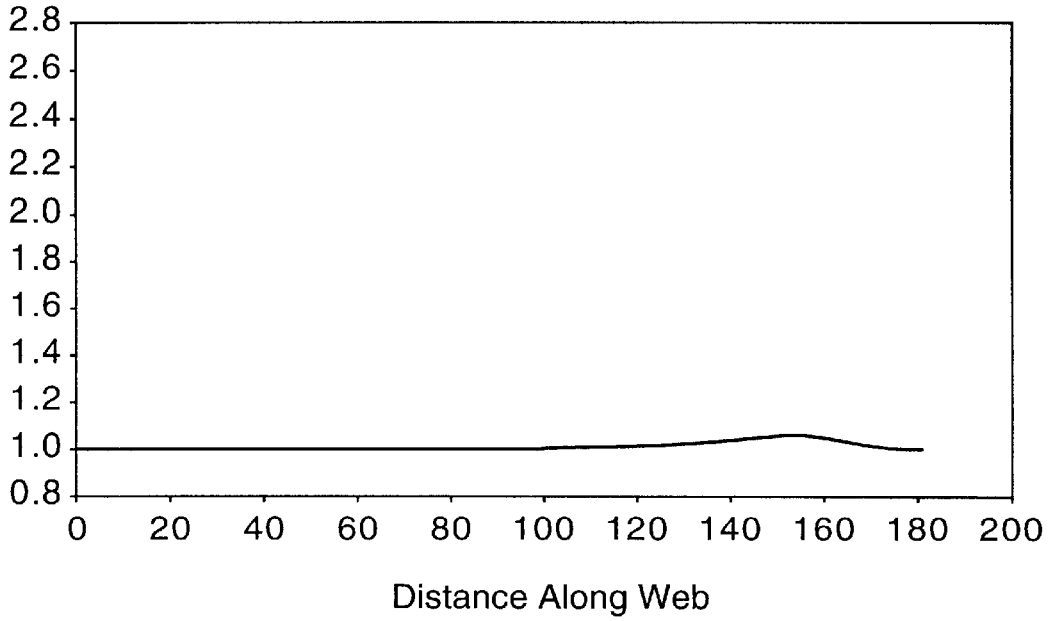
FIG. 13 is a graph of coating caliper vs. web distance when the spike of FIG. 8 encounters one periodic pick-and-place device having a period of 10 followed by one device having a period of 5 and six devices having a period of 2.

FIG. 13 shows the results for a train of eight contacting devices where the first device has a period of 10, the second device has a period of 5, and the third through eighth devices have a period of 2. Compared to the devices whose actions are shown in FIG. 9 through FIG. 11, the spike image amplitude is further reduced and a significant improvement in coating caliper uniformity is obtained.

Similar coating improvement results are obtained when the random defect is a depression (e.g., an uncoated void) rather than a spike.

The random spike and depression defects discussed above are one general class of defect that may be presented to the improvement station. The second important class of defect is a periodically repeating defect. Of course, in manufacturing coating facilities it is common to have both classes occurring simultaneously. If a periodic train of high or low coating spikes or depressions is present on a continuously running web, the coating equipment operators usually seek the cause of the defect and try to eliminate it. A single periodic pick-and-place device as illustrated in FIG. 7 may not help and may even further deteriorate the quality of the coating. However, intermittent periodic contacting of the coating by devices similar in function to that exemplified in FIG. 7 produces an improvement in coating uniformity when more than two devices are employed and when the device periods are properly chosen. Improvements are found for both random and continuous, periodic variations and combinations of the two. In general, better results will be obtained when an effort is made to adjust the relative timing of the contacts by individual devices, so that undesirable additive effects can be avoided. The use of rolls running in continuous contact with the coating avoids this complication and provides a somewhat simpler and preferred solution. Because every increment of a roll surface running on a web periodically contacts the web, a roll surface can be considered to be a series of connected intermittent periodic contacting surfaces. Similarly, a rotating endless belt can perform the same function as a roll. If desired, a belt in the form of a Mobius strip can be employed. Those skilled in the art of coating will recognize that other devices such as elliptical rolls or brushes can be adapted to serve as periodic pick-and-place devices in the improvement station. Exact periodicity of the devices is not required. Mere repeating contact may suffice.

Figure 14:
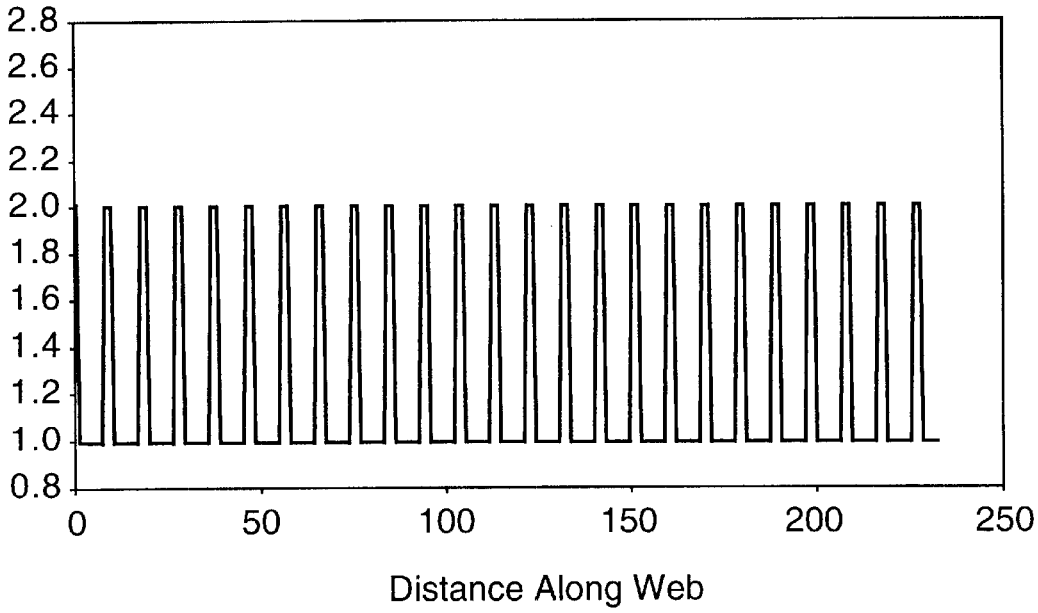
FIG. 14 is a graph of coating caliper vs. web distance for a repeating spike defect having a period of 10.
Figure 15:
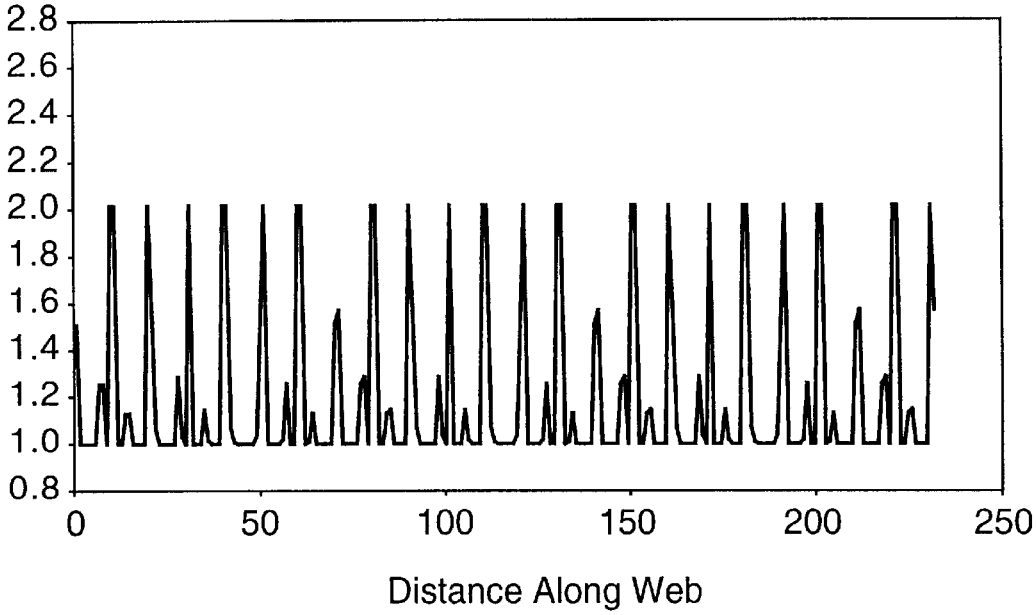
FIG. 15 is a graph of coating caliper vs. web distance when the spikes of FIG. 14 encounter a periodic pick-and-place device having a period of 7.

FIG. 14 shows a graph of liquid coating caliper vs. distance along a web for a succession of equal amplitude repeating spike inputs approaching a periodic contacting pick-and-place transfer device. If a pick-and-place device periodically and synchronously contacts this repeating defect and if the period equals the defect period, there is no change produced by the device after the initial start-up. This is also true if the period of the device is some integer multiple of the defect period. Simulation of the contacting process shows that a single device will produce more defective spikes if the period is shorter than the input defect period. FIG. 15 shows this result when a repeating defect having a period of 10 encounters a periodic pick-and-place roll device having a period of 7.

Figure 16:
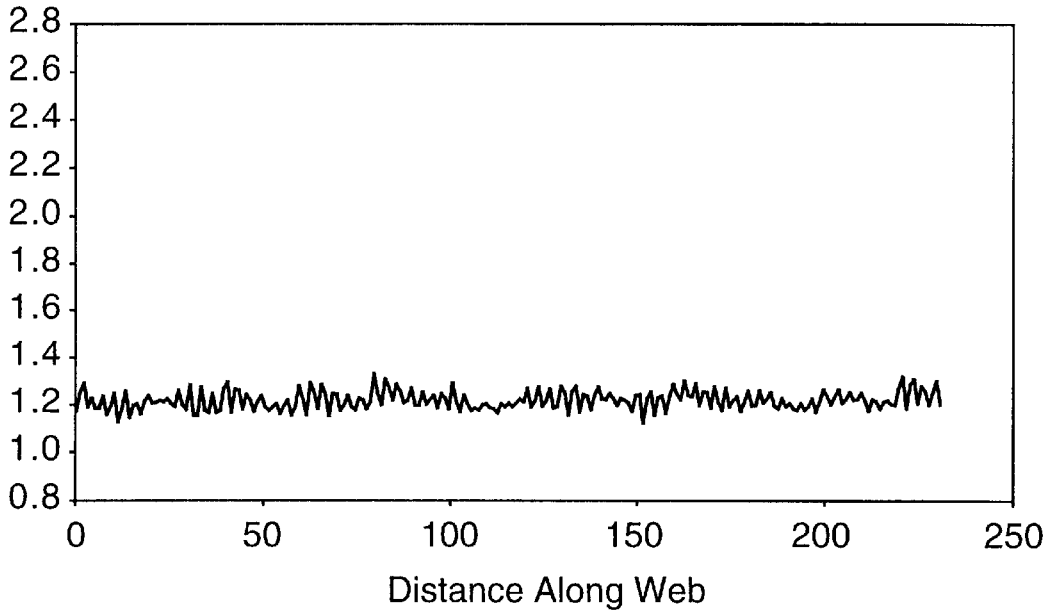
FIG. 16 is a graph of coating caliper vs. web distance when the spikes of FIG. 14 encounter a train of seven periodic pick-and-place devices having periods of 7, 5, 4, 8, 3, 3 and 3, respectively.
Figure 17:
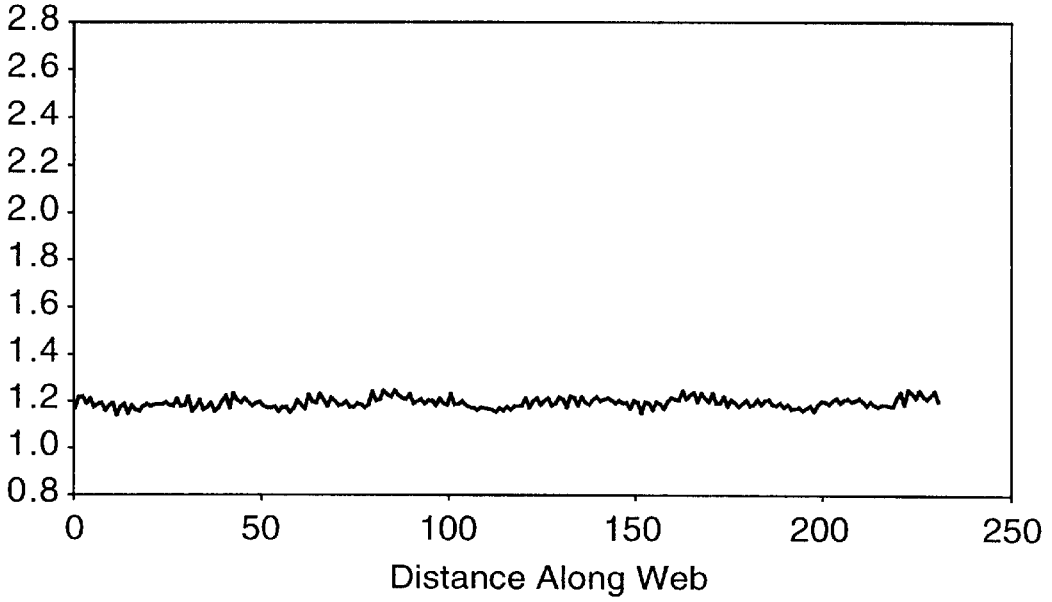
FIG. 17 is a graph of coating caliper vs. web distance when the spikes of FIG. 14 encounter a train of eight periodic pick-and-place devices having periods of 7, 5, 4, 8, 3, 3, 3 and 2, respectively.

By using multiple devices and properly selecting their periods of contact, we can substantially improve the quality of even a grossly non-uniform input coating. FIG. 16 and FIG. 17 show the simulation results when coatings having the defect pattern shown in FIG. 14 were exposed to trains of seven or eight periodic pick-and-place roll devices having periods that were not all related to one another. In FIG. 16, the devices had periods of 7, 5, 4, 8, 3, 3 and 3. In FIG. 17, the devices had periods of 7, 5, 4, 8, 3, 3, 3 and 2. In both cases, the amplitude of the highest spikes diminished by greater than 75%. Thus even though the number of spikes increased, overall a significant improvement in coating caliper uniformity was obtained.

Factors such as drying, curing, gellation, crystallization or a phase change occurring with the passage of time can impose limitations on the number of rolls employed. If the coating liquid contains a volatile component, the time necessary to translate through many rolls may allow drying to proceed to the extent that the liquid may solidify. Drying is actually accelerated by the improvement station, as is explained in more detail below. In any event, if a coating phase change occurs on the rolls for any reason during operation of the improvement station, this will usually lead to disruptions and patterns in the coating on the web. Therefore, in general we prefer to produce the desired degree of coating uniformity using as few rolls as possible.

Figure 18:
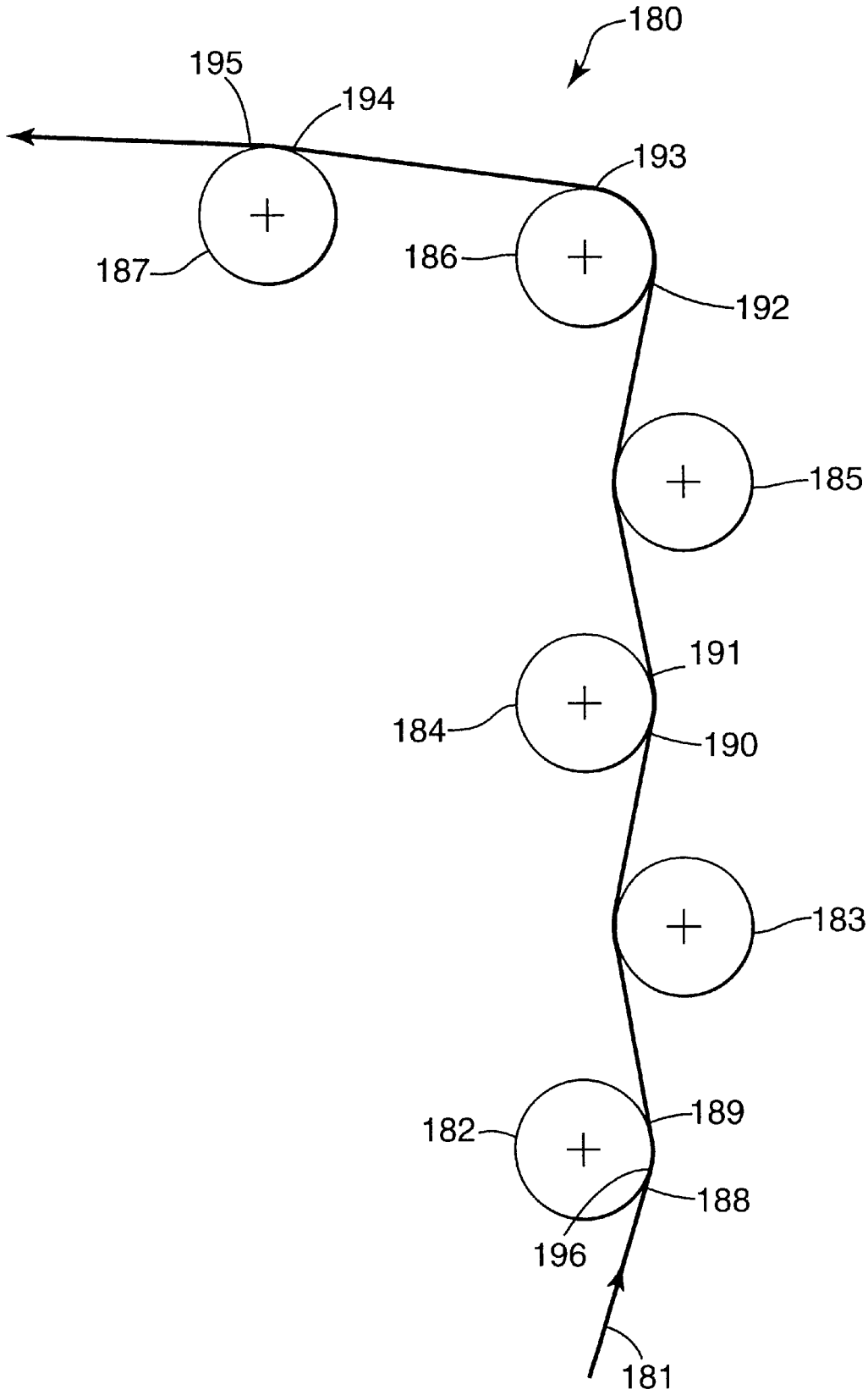
FIG. 18 is a schematic side view of an apparatus of the invention that employs an improvement station having a train of equal diameter non-equally driven contacting rolls.

FIG. 18 shows a uniformity improvement station 180 that uses a train of equally-sized, unequal speed pick-and-place roll contactors. Liquid-coated web 181 is coated on one surface (using an electrostatic spray head not shown in FIG. 18) prior to entering improvement station 180. Liquid coating caliper on web 181 spatially varies in the down-web direction at any instant in time as it approaches pick-and-place contactor roll 182. To a fixed observer, the coating caliper would exhibit time variations. This variation may contain transient, random, periodic, and transient periodic components in the down web direction. Web 181 is directed along a path through station 180 and into contact with the pick-and-place contactor rolls 182, 184, 186 and 187 by idler rolls 183 and 185. The path is chosen so that the wet coated side of the web comes into physical contact with the pick-and-place rolls. Pick-and-place rolls 182, 184, 186 and 187 (which as shown in FIG. 18 all have the same diameter) are driven so that they rotate with web 181 but at speeds that vary with respect to one another. The speeds are adjusted to provide an improvement in coating uniformity on web 181. At least two and preferably more than two of the pick-and-place rolls 182, 184, 186 and 187 do not have the same speed and are not integer multiples of one another.

Referring for the moment to pick-and place roll 182, the liquid coating splits at separation point 189. A portion of the coating travels onward with the web and the remainder travels with roll 182 as it rotates away from separation point 189. Variations in coating caliper just prior to separation point 189 are mirrored in both the liquid caliper on web 181 and the liquid caliper on the surface of roll 182 as web 181 and roll 182 leave separation point 189. After the coating on web 181 first contacts roll 182 and roll 182 has made one revolution, the liquid on roll 182 and incoming liquid on web 181 meet at entry point 188, thereby forming a liquid filled nip region 196 between points 188 and 189. Region 196 is without air entrainment. To a fixed observer, the flow rate of the liquid entering region 196 is the sum of the liquid entering on the web 181 and the liquid entering on the roll 182. The net action of roll 182 is to pick material from web 181 at one position along the web and place a portion of the material down again at another position along the web.

In a similar fashion, the liquid coating splits at separation points 191, 193 and 195. A portion of the coating re-contacts web 181 at entry points 190, 192 and 194 and is reapplied to web 181.

As with the trains of intermittent pick-and-place contacting devices discussed above, random or periodic variations in the liquid coating caliper on the incoming web will be reduced in severity and desirably the variations will be substantially eliminated by the pick-and-place action of the periodic contacting rolls of FIG. 18. Also, as with the devices discussed above, a single roll running in contact with the liquid coating on the web, or a train of periodically related rolls, will generally tend to propagate defects and produce large amounts of costly scrap.

By using multiple pick-and-place rolls we can simultaneously reduce the amplitude of and merge successive spikes or depressions together to form a continuously slightly varying but spike- and depression-free coating of good uniformity. As shown in FIG. 18, this can be accomplished by using roll devices of equal diameters driven at unequal speeds. As shown in FIG. 1*a*, FIG. 3 and FIG. 4, this can also be accomplished by varying the diameters of a train of roll devices. If the rolls are not independently driven, but instead rotated by the traction with the web, then the period of each roll is related to its diameter and its traction with the wet web. Selection of differently sized rolls can require extra time for initial setup, but because the rolls are undriven and can rotate with the web, the overall cost of the improvement station will be substantially reduced.

In the absence of a detailed mathematical simulation, a recommended experimental procedure for determining a set of pick-and-place roll diameters and therefore their periods is as follows. First, measure the down web coating weight continuously and determine the period, P, of the input of an undesired periodic defect to the improvement station. Then select a series of pick-and-place roll diameters with periods ranging from less than to larger than the input period avoiding integer multiples or divisors of that period. From this group, determine which roll gives the best improvement in uniformity by itself alone. From the remaining group, select a second roll that gives the best improvement in uniformity when used with the first selected roll. After the first two rolls are determined, continue adding additional pick-and-place rolls one by one based on which from among those available will give the best improvement. The best set of rolls is dependent upon the uniformity criterion used and the initial unimproved down web variation present. Our preferred starting set of rolls include those with periods, Q, ranging from Q=0.26 to 1.97 times the period of the input defect, in increments of 0.03. Exceptions are Q=0.5, 0.8, 1.1, 1.25, 1.4, and 1.7. Periods of (Q+nP) and (Q+kP) where n is an integer and k=1/n are also suggested.

Figure 19:
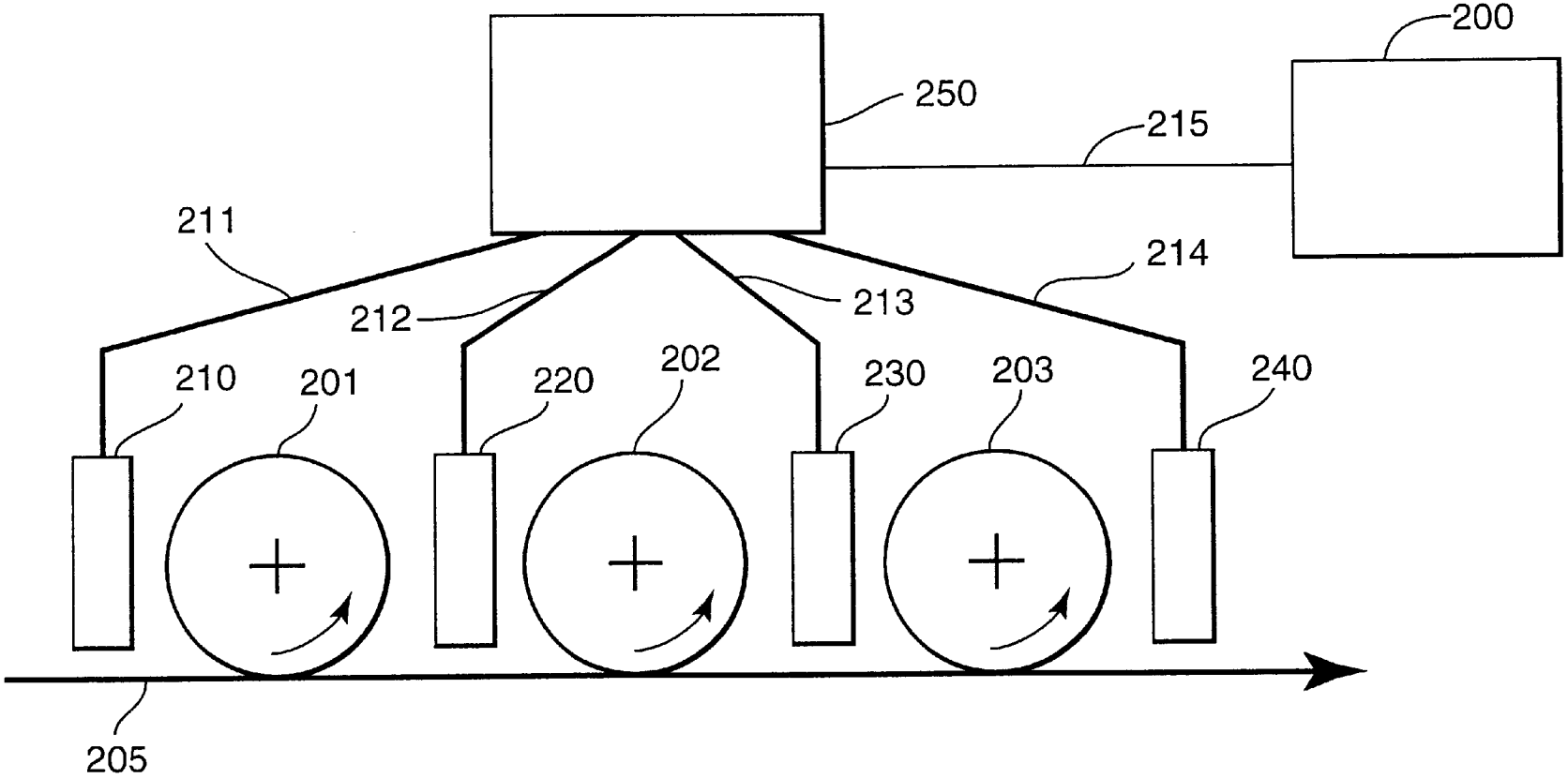
FIG. 19 is a schematic side view of a control system for use in the invention.

FIG. 19 shows a caliper monitoring and control system for use in an improvement station 200. This system permits monitoring of the coating caliper variation and adjustment in the period of one or more of the pick-and-place devices in the improvement station, thereby permitting improvement or other desired alteration of the coating uniformity. This will be especially useful if the period of the incoming deviation changes. Referring to FIG. 19, pick-and-place transfer rolls 201, 202 and 203 are attached to powered driving systems (not shown in FIG. 19) that can independently control the rates of rotation of the rolls in response to a signal or signals from controller 250. The rates of rotation need not all match one another and need not match the speed of the substrate 205. Sensors 210, 220, 230 and 240 can sense one or more properties (e.g., caliper) of substrate 205 or the coating thereon, and can be placed before or after one or more of the pick-and-place rolls 201, 202 and 203. Sensors 210, 220, 230 and 240 are connected to controller 250 via signal lines 211, 212, 213 and 214. Controller 250 processes signals from one or more of sensors 210, 220, 230 and 240, applies the desired logic and control functions, and produces appropriate analog or digital adjustment signals. These adjustment signals can be sent to the motor drives for one or more of pick-and-place rolls 201, 202 and 203 to produce adjustments in the speeds of one or more of the rolls. In one embodiment, the automatic controller 250 can be a microprocessor that is programmed to compute the standard deviation of the coating caliper at the output side of roll 201 and to implement a control function to seek the minimum standard deviation of the improved coating caliper. Depending on whether or not rolls 201, 202 and 203 are controlled individually or together, appropriate single or multi-variable closed-loop control algorithms from sensors positioned after the remaining pick-and-place rolls can also be employed to control coating uniformity. Sensors 210, 220, 230 and 240 can employ a variety of sensing systems, such as optical density gauges, beta gauges, capacitance gages, fluorescence gauges or absorbance gauges. If desired, fewer sensors than pick-and-place rolls can be employed. For example, a single sensor such as sensor 240 can be used to monitor coating caliper and sequentially or otherwise implement a control function for pick-and-place rolls 201, 202 and 203.

As noted above, the improvement station can employ driven pick-and-place rolls whose rotational speed is selected or varied before or during operation of the improvement station. The period of a pick-and-place roll can be varied in other ways as well. For example, the roll diameter can be changed (e.g., by inflating or deflating or otherwise expanding or shrinking the roll) while maintaining the roll's surface speed. The rolls do not have to have constant diameters; if desired they can have crowned, dished, conical or other sectional shapes. These other shapes can help vary the periods of a set of rolls. Also, the position of the rolls or the substrate path length between rolls can be varied during operation. One or more of the rolls can be positioned so that its axis of rotation is not perpendicular (or is not always perpendicular) to the substrate path. Such positioning can improve performance, because such a roll will tend to pick up coating and reapply it at a laterally displaced position on the substrate. The liquid flow rate to the electrostatic spray head can also be modulated, e.g., periodically, and that period can be varied. All such variations are a useful substitute for or an addition to the roll sizing rules of thumb discussed above. All can be used to affect the performance of the improvement station and the uniformity of the caliper of the finished coating. For example, we have found that small variations in the relative speeds or periodicity of one or more of the pick-and-place devices, or between one or more of the devices and the substrate, are useful for enhancing performance. This is especially useful when a limited number of roll sizes or a limited number of periods are employed. Random or controlled variations can be employed. The variation preferably is accomplished by independently driving the rolls using separate motors and varying the motor speeds. Those skilled in the art will appreciate that the speeds of rotation can also be varied in other ways, e.g., by using variable speed transmissions, belt and pulley or gear chain and sprocket systems where a pulley or sprocket diameter is changed, limited slip clutches, brakes, or rolls that are not directly driven but are instead frictionally driven by contact with another roll. Periodic and non-periodic variations can be employed. Non-periodic variations can include intermittent variations and variations based on linear ramp functions in time, random walks and other non-periodic functions. All such variations appear to be capable of improving the performance of an improvement station containing a fixed number of rolls. Improved results are obtained with speed variations having amplitudes as low as 0.5 percent of the average.

Constant speed differentials are also useful. This allows one to choose periods of rotation that avoid poor performance conditions. At fixed rotational speeds these conditions are preferably avoided by selecting the roll sizes.

Combined use of an electrostatic spray head whose drop pattern can be varied together with an improvement station provides a complementary set of advantages. The electrostatic spray head applies a pattern of drops onto a substrate or onto a transfer surface and thence onto a substrate. If a fixed flow rate to the spray head is maintained, the substrate translational speed is constant, and most of the drops deposit upon or are transferred to the substrate, then the average deposition of liquid will be nearly uniform. However, since the liquid usually deposits itself in imperfectly spaced drops, there will be local variations in the coating caliper. Alteration in the electrostatic field can cause the drop pattern to vary in the cross-web direction, thereby shifting the high and low spots in the coating caliper back and forth in the cross-web direction. The improvement station can eliminate these cross-web caliper variations. The improvement station can also convert the drops to a continuous coating, or improve the uniformity of the coating, or shorten the time and machine length needed to accomplish drop spreading. The act of contacting the initial drops with rolls or other selected pick-and-place devices, removing a portion of the drop liquid, then placing that removed portion back on the substrate in some other position increases the surface coverage on the substrate, reduces the distance between coated spots and in some instances increases the drop population density. The improvement station also creates pressure forces on the drop and substrate, thereby accelerating the rate of drop spreading. By changing the drop pattern from the spray head (and especially by changing the pattern in a direction other than the machine direction), the effectiveness of the improvement station is increased. Thus, the combined use of an electrostatic spray head and selected pick-and-place devices improves the uniformity of the final coating.

Stated another way, the above-described alteration in electrostatic field and changed drop pattern improves coating uniformity by presenting to the improvement station a deliberately variable coating having caliper variations whose positions shift back and forth in a direction other than the machine direction.

If the average drop diameter is less than the desired coating thickness and the spraying deposition rate is sufficient to produce a continuous coating, the statistical nature of spraying will nonetheless produce non-uniformities in the coating caliper. Here too, the use of rolls or other selected pick-and-place devices can improve coating uniformity.

Beneficial combinations of the electrostatic spray head and pick-and-place devices can be tested experimentally or simulated for each particular application. Through the use of our invention, 100% solids coating compositions can be converted to void-free or substantially void-free cured coatings with very low average calipers. For example, coatings having thicknesses less than 10 micrometers, less than 1 micrometer, less than 0.5 micrometer or even less than 0.1 micrometer can readily be obtained. Coatings having thicknesses greater than 10 micrometers (e.g., greater than 100 micrometers) can also be obtained. For such thicker coatings it may be useful to groove, knurl, etch or otherwise texture the surfaces of one or more (or even all) of the pick-and-place devices so that they can accommodate the increased wet coating thickness.

The improvement station can substantially reduce the time required to produce a dry substrate, and substantially ameliorate the effect of coating caliper surges. The improvement station diminishes coating caliper surges for the reasons already explained above. Even if the coating entering the improvement station is already uniform, the improvement station also greatly increases the rate of drying. Without intending to be bound by theory, we believe that the repeated contact of the wet coating with the pick-and-place devices increases the exposed liquid surface area, thereby increasing the rate of heat and mass transfer. The repeated splitting, removal and re-deposition of liquid on the substrate may also enhance the rate of drying, by increasing temperature and concentration gradients and the heat and mass transfer rate. In addition, the proximity and motion of the pick-and-place device to the wet substrate may help break up rate limiting boundary layers near the liquid surface of the wet coating. All of these factors appear to aid in drying. In processes involving a moving web, this enables use of smaller or shorter drying stations (e.g., drying ovens or blowers) down web from the coating station. If desired, the improvement station can extend into the drying station.

The methods and apparatus of the invention can be used to apply coatings on a variety of flexible or rigid substrates, including paper, plastics (e.g., polyolefins such as polyethylene and polypropylene; polyesters; phenolics; polycarbonates; polyimides; polyamides; polyacetals; polyvinyl alcohols; phenylene oxides; polyarylsulfones; polystyrenes; silicones; ureas; diallyl phthalates; acrylics; cellulose acetates; chlorinated polymers such as polyvinyl chloride; fluorocarbons, epoxies; melamines; and the like), rubbers, glasses, ceramics, metals, biologically derived materials, and combinations or composites thereof. If desired, the substrate can be pretreated prior to application of the coating (e.g., using a primer, corona treatment, flame treatment or other surface treatment) to make the substrate surface receptive to the coating. The substrate can be substantially continuous (e.g., a web) or of finite length (e.g., a sheet). The substrate can have a variety of surface topographies (e.g., smooth, textured, patterned, microstructured or porous) and a variety of bulk properties (e.g., homogenous throughout, heterogeneous, corrugated, woven or nonwoven). For example, when coating microstructured substrates (and assuming that the coating is applied from above the substrate, with the targeted microstructure being on the top surface of the substrate), the coating can readily be applied to the uppermost portions of the microstructure. The coating liquid's surface tension, the applied nip pressure (if any), and the surface energy and geometry of the microstructure will determine if coating in the lowermost (e.g., valley portions) of the microstructure will occur. Substrate precharging can be employed if desired, e.g., to help deposit coating within the valley portions of a microstructure. For fibrous webs coated using a drum transfer method such as shown in FIG. 1*a* through FIG. 3 or a transfer belt method such as is shown in FIG. 4*a* and FIG. 4*b*, wicking flow primarily determines the depth of penetration of the coating.

The substrates can have a variety of uses, including tapes; membranes (e.g., fuel cell membranes); insulation; optical films or components; photographic films; electronic films, circuits or components; precursors thereof, and the like. The substrates can have one layer or many layers under the coating layer.

The invention is further illustrated in the following examples, in which all parts and percentages are by weight unless otherwise indicated.

EXAMPLE 1

A 35-micrometer thick, 30.5 cm wide polyethylene terephthalate (PET) web was passed over an idler roll, under a 50.8 cm diameter by 61 cm wide grounded stainless steel drum, and over another idler roll. The web contacted approximately one-half the circumference of the drum. The drum co-rotated at the same surface speed as the moving web, namely at a speed S of 7.62 m/min. The drum therefor had a radian frequency of rotation of $\omega_D = S/R_D$ of 0.5 $sec^{-1}$ and a period of rotation of $\tau_D = 2\pi/\omega_D$ of 12.57 sec.

An HP6216A 0–30 VDC power source (Hewlett-Packard, Inc.) and a PM5134 function generator (Phillips Electronics NV) were connected in series to the input of a PS/WG-50N6-DM 50 kVDC, 6-milliamperes negative-output, high-voltage power supply (Glassman High Voltage Inc.). The HP6216A power source was adjusted to provide approximately 6.5 VDC and the PM5134 function generator was adjusted to provide an AC sine wave with a period of 27.4 seconds as measured with an HP5315B universal counter (Hewlett-Packard, Inc.). The amplitude of the sine wave was increased until the input voltage to the Glassman high voltage power supply varied from 4.51 to 8.62 volts as measured with a Fluke 8000A digital multimeter (Fluke Corp.). With this oscillatory input the output voltage was observed to vary from minus 22.6 to minus 42.6 kV. The output of the Glassman power supply was fed through two 200 MΩ safety resistors connected in series to the die wire of an electrostatic spray head that could operate in the electrospray mode like that of U.S. Pat. No. 5,326,598. The spray head had been modified to operate in the restricted flow mode described in U.S. Pat. No. 5,702,527. The 400 MΩ □total safety resistance ensured that no more than 125 microamperes could be continuously drawn from the power supply even if a person accidentally touched the die wire. The field adjusting electrodes (also known as "extractor rods") of the spray head were grounded. The die wire was held at a fixed distance of 10.8 cm from the surface of the drum. The spray head slot was 33 cm wide. However, due to charge repulsion within the mist of atomized drops, the spray head was capable of spraying a 38 cm wide mist across the drum.

Grounded side pans having a width of 14 cm and a length of 25.4 cm were placed below the ends of the spray head and at a location just above the drum. The side pans masked off the coating area and ducted away excess coating. The side pans could be adjusted from side to side on sliding rods to permit coating widths of 10 to 30 cm. Only the mist falling between the side pans reached the drum. A distance of 30.4 cm separated the side pans so that the full width of the web could be coated.

A nip roll having an overall outside diameter of 10.2 cm was placed against the drum and held in position with a nip pressure of 0.276 Mpa by two air cylinders. The nip roll had a 0.794 cm thick polymeric covering layer with an 80 durometer hardness.

A solventless silicone acrylate UV curable release coating formulation like that of Example 10 of U.S. Pat. No. 5,858,545 was prepared and modified by the addition of 0.3 parts per hundred (pph) of 2,2'-(2,5-thiophenediyl)bis[5-tert-butylbenzoxazole] (UVITEX™-OB fluorescing dye, Ciba Specialty Chemicals Corp.)

The release formulation was electrosprayed onto the top of the rotating metal drum at a flow rate sufficient to produce a 1.2 micrometer thick coating on the drum. After a few rotations of the drum, the surface of the drum became wet with the release coating and an equilibrium was reached. As the drum rotated past the electrospray coating head, the drops in the electrospray mist were attracted to the grounded drum where the charges on the drops were dissipated.

An array of liquid mists projected from the discharge wire towards the drum, forming a changing pattern of atomized drops on the drum. At the maximum Glassman power supply voltage of minus 42.6 kV, there were about 2 to 3 mists per centimeter along the wire. As the electrostatic field decreased, the number of mists decreased and the spacing between mists increased. The periodic variation in the electrostatic field caused the mists to shift back and forth across the width of the drum, producing the above-mentioned changing pattern of drops and providing shifting regions of high and low caliper coating across the drum. The high and low caliper coating regions could be more easily observed by shining a Model 801 "black light" fluorescent fixture (Visual Effects, Inc.) on the wet coating.

The die wire was longer than the die and because the non-wetted segments of the die wire went into corona, a non-linear current passed through the safety resistor as the Glassman power supply voltage oscillated. From current-voltage measurements made at the Glassman power supply with and without the safety resistors present and when no coating solution was present, the voltage on the die wire was estimated to vary between minus 22 kV and minus 25 kV during a period. Since the current voltage relationship for corona is not linear, the variation of the voltage on the wire was not sinusoidal. Despite this, the separation between mists on the wire was observed to slowly increase and then decrease in a periodic fashion along the wire. The non-sinusoidal nature of the variation could also be observed. Those skilled in the art will recognize that by removing the safety resistor, a sinusoidal voltage variation could be caused to occur on the die wire.

Figure 20:
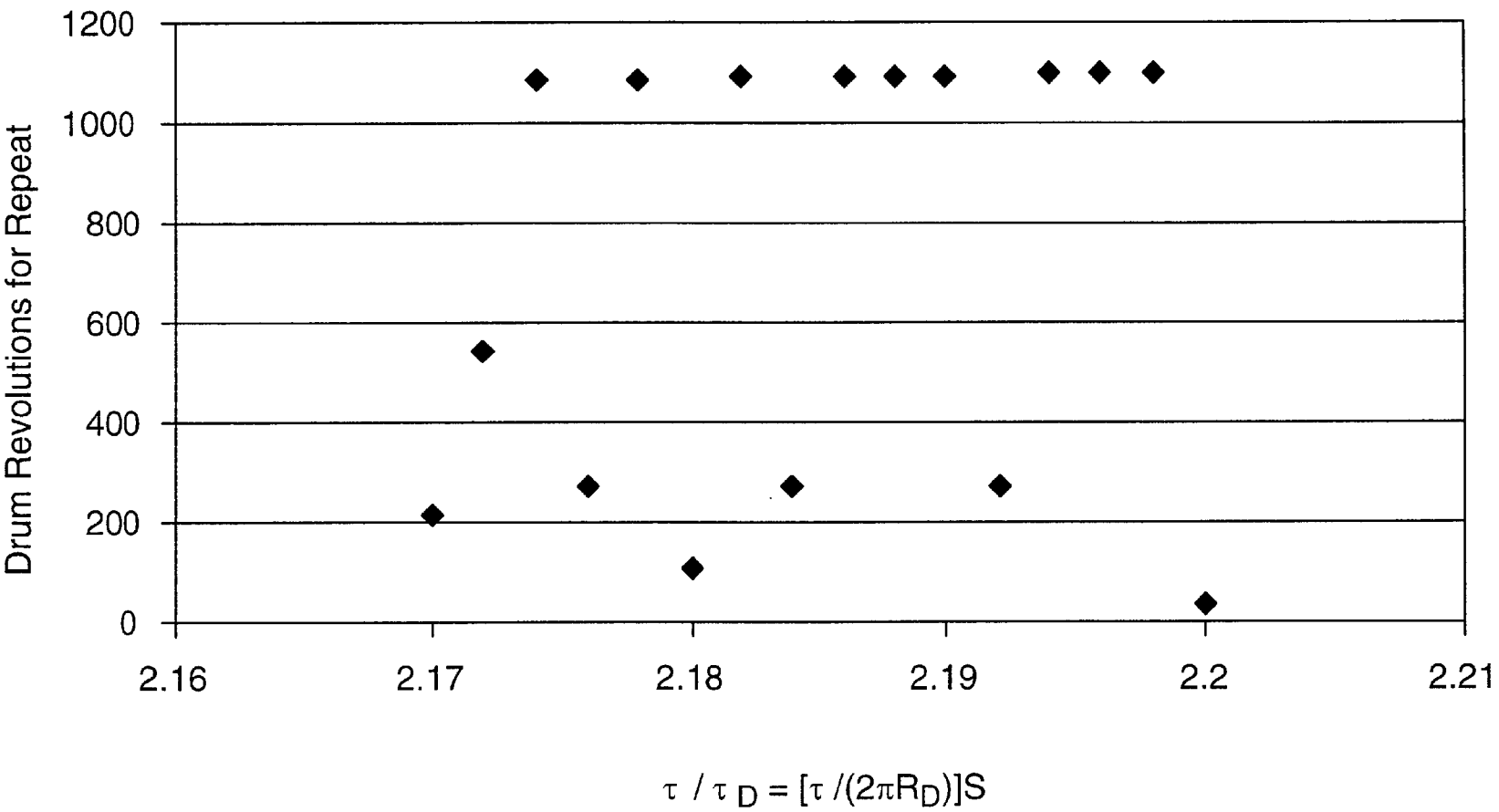
FIG. 20 is a graph showing the number of drum revolutions required to provide a repeated pattern of drops under a variety of electrostatic field conditions.

The time for one drum revolution was less that the time for one oscillation of the Glassman power supply. Since $\tau_D$(12.57 sec) is less than $\tau$(27.4 sec), the repeat of the coating pattern can be determined from the requirement $I_L\tau_D=I_S\tau$ where $I_S$ and $I_L$ are integers, with $I_S$ being the smaller integer and $I_L$ being the larger integer. Since $\tau_D$ is the time to make one revolution of the drum, $I_L$ is the number of drum revolutions needed before the spray pattern is repeated on the drum. For $\tau$=27.4 seconds, $R_D$=0.254 m, S=7.62 m/min, $N=\tau/\tau_D=I_L/I_S=[\tau/(2\pi R_D)]S=2.18$, and $NI_S=I_L$ as the criteria for a repeat coating pattern, a spreadsheet calculation shows 2.18(50)=109 as the first product that gives an integer result. Consequently the drum makes 109 revolutions before a given point on the drum sees the identical coating pattern. Likewise the oscillation of the drop pattern repeats itself 50 times before the same drop pattern lands on a repeat point on the drum. The results of spreadsheet calculations for different web speeds or spray pattern oscillations that give $\tau/\tau_D$=2.17 to $\tau/\tau_D$=2.2 in increments of 0.002 are shown in the FIG. 20. If the period of the pattern is increased very slightly (e.g., from 27.4 to 27.65 seconds) or the speed of the web is increased very slightly (e.g., from 7.62 to 7.69 m/min), then $\tau/\tau_D$=2.2 and the spreadsheet calculation reveals 2.2(5)=11. For this slight increase the mist will have a repeat pattern for every 11 revolutions of the drum and every 5 periods of the spray.

As the drum rotated past the moving web, the applied drops contacted the web surface. The nip roll forced the drops to spread and coalesce into a void-free coating. The surface of the nip roll had a deep gouge at one location, causing an observable defect in the coating.

When the web left the rotating drum, some of the coating liquid remained on the drum while the rest remained on the web. Observation of the web immediately after the separation point using the black light showed that the shifting areas of low coating caliper were transferred to the web.

The coated web was routed through an eight roll improvement station where the wet side of the web contacted the eight pick-and-place rolls. The path length from the nip to the start of the improvement station was 0.86 m, and the path length through the improvement station was 1.14 m. The eight rolls had respective diameters of 54.86, 69.52, 39.65, 56.90, 41.66, 72.85, 66.04, and 52.53 mm, all with a tolerance of plus or minus 0.025 mm. The rolls were obtained from Webex Inc. as dynamically balanced steel live shaft rolls with chrome plated roll faces finished to 16 Ra. The improvement station eliminated all uncoated areas on the web, including the observable pattern caused by the gouge mark on the nip roll, and provided a coating having further visually improved uniformity when evaluated using black light illumination.

EXAMPLE 2

Using the method, web and coating formulation of Example 1, the side pans were adjusted to various separation widths less than 30.4 cm. The web speed was fixed at 7.62 m/min and a 1.2 micrometer thick coating was applied to the web with a nip pressure of 0.28 MPa. A uniform coating was obtained at each side-pan separation as evaluated using black light illumination.

EXAMPLE 3

Using the method, web and coating formulation of Example 1, the web was again coated with the release formulation. A fine fibrous piece of dirt on the die wire caused a slightly higher flow rate near one end of the die.

This produced a region of increased coating thickness, and could be observed by passing the coated web sample beneath the sensor of a model LS-50B Luminescence Spectrophotometer (Perkin Elmer Instruments) and noting the increased fluorescence intensity near the affected end of the die wire. The remainder of the web exhibited very good coating uniformity as manifested by a uniform fluorescence intensity.

Release characteristics were evaluated by applying 2.54 cm wide strips of No. 845 book tape (3M) to the upper (coated) side and backside of samples of the coated web, and to the corresponding sides of control samples of the uncoated web. The samples were aged for 3 days or seven days at room temperature or at 70° C. The nature of the applied coating was evaluated by measuring the 180° peel force required to remove the tape at a rate of 2.3 m/min. Transfer of the coating was evaluated by re-adhering the removed tape samples to clean glass, and then measuring the 180° peel force required to remove the tape from the glass. The sample description, peel strength values are set out below in Table I.

TABLE I

| Description | Release @ 20° C., g/25 mm | Re-adhesion @ 20° C., g/25 mm | Release @ 70° C., g/25 mm | Re-adhesion @ 70° C., g/25 mm |
|---|---|---|---|---|
| Control, 3 days | 1279 | 923 | 1351 | 879 |
| Coated, 3 days | 35 | 1288 | 94 | 892 |
| Control, 7 days | 1286 | 927 | 1366 | 804 |
| Coated, 7 days | 36 | 1196 | 135 | 735 |

The data in Table I show that the applied coating provided good release properties and did not cause transfer of the release coating to the adhesive of the Book Tape. The good release and re-adhesion properties of the adhesive against the applied coating were maintained even if the coating was heat aged at 70° C. For example, the release peel force of the Control sample (7 days, 70° C.) varied by ±6% as the tape was peeled away from the glass. The release peel force of the Coated sample (7 days, 70° C.) varied by ±8% as the tape was peeled away from the glass. These similar peel variation values indicate that the coated PET sample had a surface morphology very similar to the uncoated PET sample. This data thus demonstrates the utility of the present invention for coating uniform thin films onto nonconductive webs.

Various modifications and alterations of this invention will be apparent to those skilled in the art without departing from the scope and spirit of this invention. This invention should not be restricted to that which has been set forth herein only for illustrative purposes.

We claim:

1. A method for forming a liquid coating on a substrate comprising:

a) spraying a pattern of drops of the liquid onto a conductive transfer surface from an electrostatic spray head that produces the pattern in response to an electrostatic field;

b) repeatedly electrically altering the electrostatic field during spraying, thereby repeatedly changing the pattern; and c) transferring a portion of the liquid coating from the transfer surface to a moving web.

2. A method according to claim 1 wherein the field is continuously altered.

3. A method according to claim 1 wherein the field is periodically altered.

4. A method according to claim 1 wherein the field is non-periodically altered.

5. A method according to claim 1 wherein the field is altered in response to a caliper monitoring and control system.

6. A method according to claim 1 wherein the field is altered by varying a voltage between the spray head and the substrate.

7. A method according to claim 1 wherein the field is altered by varying a voltage on a field adjusting electrode or second electrostatic spray head that is sufficiently near the spray head so that the pattern of drops changes.

8. A method for forming a liquid coating on a substrate comprising:

a) spraying a pattern of drops of the liquid onto a substrate from an electrostatic spray head that produces the pattern in response to an electrostatic field; and b) repeatedly electrically altering the electrostatic field during spraying, thereby repeatedly changing the pattern;

wherein the spray head comprises a discharge wire, an array of mists of liquid is discharged from the wire, and the number and spacing of mists varies during spraying.

9. A method according to claim 1 wherein the spray head comprises a series of discharge protrusions, one or more arrays of mists of liquid are discharged from the protrusions, and the mist patterns vary during spraying.

10. A method according to claim 1 wherein the drops have an average diameter, the liquid coating has an average caliper, the average diameter is greater than the average caliper and the coating is substantially void-free.

11. A method according to claim 1 wherein the coating is applied in one or more stripes that wholly or partially overlap, that abut one another, or that are separated by uncoated substrate.

12. A method according to claim 11 wherein different compositions are applied to two or more stripes.

13. A method according to claim 11 wherein the same composition is applied to two or more stripes.

14. A method for fanning a liquid coating on a moving substrate, comprising:

a) spraying a pattern of drops of the liquid onto the substrate or onto a transfer surface from an electrostatic spray head that produces the pattern in response to an electrostatic field;

b) repeatedly changing the pattern in a first direction;

c) contacting the liquid coating with two or more pick-and-place devices that improve the uniformity of the coaxing in a second direction; and d) when a transfer surface is employed, transferring a portion of the coating from the transfer surface to the substrate.

15. A method according to claim 14 wherein the field is repeatedly electrically altered.

16. A method according to claim 15 wherein the field is altered by varying a voltage between the spray head and the substrate or transfer surface.

17. A method according to claim 15 wherein the field is altered by varying the position of a field adjusting electrode or second spray head that is sufficiently near the spray head so that the pattern of drops changes.

18. A method according to claim 14 wherein the field is repeatedly mechanically altered.

19. A method according to claim 14 wherein the spray head comprises a discharge wire, an array of mists of liquid is discharged from the wire, and the number and spacing of mists varies during spraying.

20. A method according to claim 14 wherein the spray head comprises a series of discharge protrusions, one or more arrays of mists of liquid are discharged from the protrusions, and the mist patterns vary during spraying.

21. A method according to claim 14 wherein a conductive transfer surface is employed.

22. A method according to claim 14 wherein the coating is contacted with three or more pick-and-place devices.

23. A method according to claim 14 wherein the substrate comprises a moving web.

24. A method according to claim 14 wherein the drops have an average diameter, the coating has an average caliper, the average diameter is greater than the average caliper and the coating is substantially void-free.

25. A method according to claim 14 wherein the coating is applied in one or more stripes that wholly or partially overlap, that abut one another, or that are separated by uncoated substrate.

26. A method for forming a liquid coating on a substrate having a direction of motion comprising:

a) spraying drops of the liquid from an electrostatic spray head in response to an electrostatic field;

b) forming on the web an uneven liquid coating having regions of high and low coating caliper; and c) repeatedly electrically altering the electrostatic field during spraying to shift the regions of high and low coating caliper back and forth in a direction transverse to the direction of motion.

27. A coating apparatus comprising an electrostatic spray head that produces a pattern of tops and a w& coating on a conductive transfer surface in response to an electrostatic field, and a device or circuit that can repeatedly electrically alter the electrostatic field during spraying, thereby repeatedly changing the pattern, wherein the conductive transfer surface can transfer a portion of the wet coating to a substrate.

28. An apparatus according to claim 27 wherein the pattern changes in a first direction and the apparatus further comprises two or more pick-and-place devices that can periodically contact and re-contact the wet coating to improve the uniformity of the coating in a second direction.

29. An apparatus according to claim 27 wherein the field is continuously altered.

30. An apparatus according to claim 27 wherein the field is periodically altered.

31. An apparatus according to claim 27 wherein the field is non-periodically altered.

32. An apparatus according to claim 27 wherein the field is altered in response to a caliper monitoring and control system.

33. An apparatus according to claim 27 wherein the field is altered by varying a voltage between the spray head and the substrate.

34. An apparatus according to claim 27 wherein the spray head comprises a discharge wire, an array of mists of liquid is discharged from the wire, and the number and spacing of mists varies during spraying.

35. An apparatus according to claim 27 wherein the spray head comprises a series of discharge protrusions, one or more arrays of mists of liquid are discharged from the protrusions, and the mist patterns vary during spraying.

36. A coating apparatus comprising an electrostatic spray head that produces a pattern of drops and a wet coating on a conductive transfer surface in response to an electrostatic field, and a device or circuit for repeatedly electrically altering the electrostatic field during spraying, thereby repeatedly changing the pattern, and wherein the conductive transfer surface can transfer a portion of the wet coating from the transfer surface to a moving web.

37. An apparatus according to claim 27 wherein the drops have an average diameter, the coating has an average caliper, the average diameter is greater than the average caliper and the coating is substantially void-free.

38. An apparatus according to claim 27 comprising a plurality of electrostatic spray beads tat can apply one or more coating compositions to the substrate in one or more stripes.

39. An apparatus according to claim 38 wherein the spray heads apply a plurality of coating compositions to one stripe.

40. An apparatus according to claim 38 wherein the spray heads apply coating compositions to a plurality of stripes.

41. A coating apparatus comprising an electrostatic spray head that produces a pattern of drops and a wet coating on a substrate in response to an electrostatic field; a device or circuit that can alter the electrostatic field to change the pattern; and seven or more pick-and-place devices that can periodically contact and re-contact the wet coating, wherein the electrostatic field can be repeatedly altered during spraying to improve the uniformity of the coating.

42. An apparatus according to claim 41 wherein the field is repeatedly electrically altered.

43. An apparatus according to claim 42 wherein the field is altered by varying a voltage between the spray head and the substrate.

44. An apparatus according to claim 42 wherein the field is altered by varying the position of a field adjusting electrode or second electrostatic spray head that is sufficiently near the spray head so that the pattern of drops changes.

45. An apparatus according to claim 41 wherein the field is repeatedly mechanically altered.

46. An apparatus according to claim 41 wherein the spray head comprises a discharge wire, an array of mists of liquid is discharged from the wire, and the number and spacing of mists varies during spraying.

47. An apparatus according to claim 41 wherein the spray head comprises a series of discharge protrusions, one or more arrays of mists of liquid are discharged from the protrusions, and the mist patterns vary during spraying.

48. An apparatus according to claim 41 wherein the drops have an average diameter, the coating has an average caliper, the average diameter is greater than the average caliper and the coating is substantially void-free.

49. An apparatus according to claim 1 wherein a plurality of electrostatic spray heads apply one or more coating compositions to the substrate in a plurality of stripes that wholly or partially overlap, that abut one another, or that are separated by uncoated substrate.

50. A coating apparatus comprising an electrostatic spray head that in response to an electrostatic field can provide an uneven liquid coating having regions of high and low coating caliper on a substrate having a direction of motion, and a device or circuit that repeatedly electrically alters the electrostatic field during spraying to shift the regions of high and low coating caliper back and forth in a direction transverse to the direction of motion.

* * * * *

UNITED STATES PATENT AND TRADEMARK OFFICE

CERTIFICATE OF CORRECTION

PATENT NO. : 6,579,574 B2
DATED : June 17, 2003
INVENTOR(S) : Seaver, Albert E.

It is certified that error appears in the above-identified patent and that said Letters Patent is hereby corrected as shown below:

Column 6,
Line 5, "reprensenting" should be -- re-presenting --

Column 10,
Line 16, "54*c*5" should be -- 54*c* --

Column 11,
Line 62, "If the period of the…" should be -- If the period $\tau$ of the… --

Column 26,
Line 42, "fanning" should be -- forming --
Line 51, "coaxing" should be -- coating --

Column 27,
Line 32, "tops" should be -- drops -- and "w&" should be -- wet --

Signed and Sealed this

Second Day of March, 2004

JON W. DUDAS
*Acting Director of the United States Patent and Trademark Office*